US012065764B2

(12) United States Patent
Itoi

(10) Patent No.: US 12,065,764 B2
(45) Date of Patent: Aug. 20, 2024

(54) COMPOUND PAPER YARN, COMPOUND PAPER YARN MANUFACTURING DEVICE, AND COMPOUND PAPER YARN MANUFACTURING METHOD

(71) Applicant: ITOI LIFESTYLE RESEARCH CO., Osaka (JP)

(72) Inventor: Toru Itoi, Osaka (JP)

(73) Assignee: Itoi Lifestyle Research Co., Osaka (JP)

( * ) Notice: Subject to any disclaimer, the term of this patent is extended or adjusted under 35 U.S.C. 154(b) by 264 days.

(21) Appl. No.: 17/620,013

(22) PCT Filed: Mar. 24, 2021

(86) PCT No.: PCT/JP2021/012266
§ 371 (c)(1),
(2) Date: Dec. 16, 2021

(87) PCT Pub. No.: WO2021/193726
PCT Pub. Date: Sep. 30, 2021

(65) Prior Publication Data

US 2022/0356605 A1 Nov. 10, 2022

(30) Foreign Application Priority Data

Mar. 25, 2020 (JP) ..... 2020-054906

(51) Int. Cl.
*D02G 3/08* (2006.01)
*D01D 5/42* (2006.01)
(Continued)

(52) U.S. Cl.
CPC ..... *D02G 3/08* (2013.01); *D01D 5/426* (2013.01); *D01H 1/11* (2013.01); *D01H 13/04* (2013.01); *D02G 3/36* (2013.01)

(58) Field of Classification Search
CPC .. D02G 3/08; D02G 3/26; D02G 3/28; D01H 7/92; D01H 5/28; D01H 5/00; D01H 5/18;
(Continued)

(56) References Cited

U.S. PATENT DOCUMENTS 2,896,393 A * 7/1959 Marks ..... D02G 3/08 57/32
3,012,393 A * 12/1961 Shuttleworth ..... D02G 3/08 242/157 R
(Continued)

FOREIGN PATENT DOCUMENTS

CA 883041 A 10/1971
CN 101050567 A 10/2007
(Continued)

OTHER PUBLICATIONS

Office Action dated Jul. 13, 2020 issued in JP patent application No. 2020-054906, 8 pgs.
(Continued)

*Primary Examiner* — Patrick J. Lynch
(74) *Attorney, Agent, or Firm* — Brooks Kushman P.C.

(57) ABSTRACT

A compound paper yarn manufacturing device includes a Japanese paper roll, a slitter configured to slit a Japanese paper sheet fed out from the Japanese paper roll to form a plurality of Japanese paper tapes, a distributor configured to distribute the plurality of Japanese paper tapes into each single Japanese paper tape, a plurality of pairs of slip rollers formed by providing a plurality of pieces of a pair of slip rollers that feed out each distributed single Japanese paper tape while slipping, and a covering machine including a plurality of single covering units configured to perform, with
(Continued)

a first yarn added, false-twisting on the single Japanese paper tape fed out from the pair of slip rollers, and to cover with a second yarn.

12 Claims, 10 Drawing Sheets

(51) Int. Cl.
*D01H 1/11* (2006.01)
*D01H 13/04* (2006.01)
*D02G 3/36* (2006.01)

(58) Field of Classification Search
CPC .. D01H 5/20; D01H 5/22; D01H 5/26; D01H 13/04; D01H 1/11; D01H 1/115; D01G 1/0203; D01G 1/0213; D01G 1/022; D01G 1/0233
See application file for complete search history.

(56) References Cited

U.S. PATENT DOCUMENTS 3,035,405 A * 5/1962 Welsh ..... D02G 3/08 57/313
4,263,777 A * 4/1981 Wada ..... D02G 1/18 57/227
4,450,675 A * 5/1984 Petrov ..... D02G 3/34 57/328
4,495,760 A * 1/1985 Vanhelle ..... D02G 3/367 57/12
4,903,472 A * 2/1990 Vanhelle ..... D02G 3/367 57/280
5,392,588 A * 2/1995 Morrison ..... D02G 1/161 57/328
5,568,719 A * 10/1996 Proctor ..... D02G 3/367 57/328
6,263,655 B1 * 7/2001 Artzt ..... D01H 5/86 57/328
6,318,060 B1 * 11/2001 Dinkelmann ..... D01H 1/025 57/328
2003/0159424 A1 8/2003 Nakashima et al.
2006/0204753 A1 * 9/2006 Simmonds ..... D02G 3/045 428/364
2018/0320298 A1 * 11/2018 Barth ..... D04B 1/14

FOREIGN PATENT DOCUMENTS

CN 106283314 A 1/2017
CN 110592993 A 12/2019
GB 2060010 A 4/1981
GB 2060010 A * 4/1981 ..... B31F 1/0074
JP 48-043978 B 12/1973
JP 02-099628 A 4/1990
JP 09-111542 A 4/1997
JP 2001-040539 A 2/2001
JP 2003-253531 A 9/2003
JP 2003-268641 A 9/2003
JP 2007-211391 A 8/2007
JP 2013-117078 A 6/2013
JP 2013-136862 A 7/2013
JP 2015-025217 A 2/2015
JP 2016-204812 A 12/2016
JP 6577684 B 9/2019

OTHER PUBLICATIONS

Office Action dated Sep. 11, 2020 issued in JP patent application No. 2020-054906, 6 pgs.
Notice of Allowance dated Dec. 4, 2020 issued for JP patent application No. 2020-054906, 5 pgs.
International Search Report dated Jun. 22, 2021 issued for International application No. PCT/JP2021/012266, 6 pgs.
Written Opinion of the International Searching Authority dated Jun. 22, 2021 issued for International application No. PCT/JP2021/012266, 5 pgs.
Notice of Allowance dated Dec. 30, 2021 issued for TW patent application No. 110110826, 3 pgs.
Second Office Action for Chinese Application No. 202180002844.8, dated Aug. 9, 2022, 14 Pages.
Office Action dated Mar. 7, 2022 issued in CN patent application No. 202180002844.8, 7 pgs.
Office Action dated Nov. 2, 2022 issued in IN patent application No. 202117051897.

* cited by examiner

COMPOUND PAPER YARN, COMPOUND PAPER YARN MANUFACTURING DEVICE, AND COMPOUND PAPER YARN MANUFACTURING METHOD

CROSS-REFERENCE TO RELATED APPLICATIONS

This application is the U.S. national phase of PCT Application No. PCT/JP2021/012266, filed Mar. 24, 2021, which claims priority to Japanese Patent Application No. 2020-054906, filed Mar. 25, 2020, which are both incorporated by reference herein in their entireties.

TECHNICAL FIELD

The present invention relates to a yarn (hereinafter, referred to as a "compound paper yarn") formed by combining, with a paper tape, one or more types of yarns selected from a group including a long fiber and a spun yarn, a compound paper yarn manufacturing device, and a compound paper yarn manufacturing method.

BACKGROUND ART

In recent years, many products using paper yarns capable of utilizing characteristics of paper have been provided. The paper yarn is obtained by slitting sheet-shaped paper into a width of about several mm and twisting, into a yarn, a paper tape formed by the slitting. Conventionally, in a case of industrially manufacturing the paper yarn, a wound body has been obtained by slitting sheet-shaped paper into widths of various sizes by a slitter, and winding each single paper tape included in the plurality of formed paper tapes by winding into a cheese shape, a corn shape, or the like. A conventional twisted yarn manufacturer has been manufacturing a compound paper yarn by selecting a wound body around which a paper tape having a required width is wound, setting the paper tape in a covering machine, and twisting the paper tape together with a long fiber made of synthetic fibers or the like or covering the paper tape with a long fiber or the like. The covering refers to a process of manufacturing a covering yarn by winding a long fiber or the like around a core yarn or the like in a coil shape. A covering yarn in which a long fiber, a spun yarn, or the like is wound around an outer periphery of a paper tape can be said to be a type of compound paper yarn.

In a case of winding a yarn, irregularities due to the yarn are formed on a surface of a portion of the yarn already wound. A portion of the yarn to be further wound fits into a recess formed between portions of the yarn already wound. Therefore, in winding the yarn, winding collapse of the yarn hardly occurs. Whereas, in a case of winding a paper tape, the paper tape has a flat tape shape, irregularities hardly occur on a surface of a portion of the paper tape already wound, and the paper tape easily slides on this surface. Therefore, in winding the paper tape into a cheese shape or a corn shape, in storing a wound body of the wound paper tape, or in unwinding the paper tape from the wound body to manufacture a compound paper yarn, winding collapse of the paper tape may occur. In particular, for a paper tape with a narrow width of a width of about 1 mm to about 2 mm, the paper tape tends to break by a slight impact when being wound, since not only winding collapse easily occurs but also breaking elongation of the paper tape having a narrow width is small. Therefore, conventionally, in a paper tape with a narrow width, there has been a lot of material loss, the quality has been unstable, and manufacturing has been difficult, since winding is not stable, handling is very difficult, and the paper tape easily break when being wound or drawn out from the wound body. In the present specification, the breaking elongation is elongation (tensile elongation) when a test sample is pulled at a speed of 200 mm/min with use of a tensile tester in accordance with ASTM-D-882 or JIS-C-2151 and the sample is broken. When $L_0$ is a "sample length before test" and L is a "sample length at breakage", the breaking elongation is calculated by the formula "tensile elongation (%)=$100\times(L-L_0)/L_0$".

Conventionally, when a compound paper yarn is manufactured by a covering machine with use of a paper tape, breakage of the paper tape frequently occurs, which destabilizes quality of the compound paper yarn and causes poor productivity. Conventionally, in order to manufacture the compound paper yarn, winding work of the paper tape and work of drawing out the wound paper tape from the cheese shape or the cone shape and setting the paper tape in each covering unit provided in the covering machine have been performed manually every time. Since such manual work is required, labor loss and time loss are large, and cost reduction of the compound paper yarn is hindered, in a conventional compound paper yarn manufacturing device and compound paper yarn manufacturing method.

PRIOR ART DOCUMENT

Patent Document

Patent Document 1: Japanese Unexamined Patent Application Publication No. 6577684

DISCLOSURE OF THE INVENTION

Problems to be Solved by the Invention

Therefore, instead of once winding a paper tape formed by slitting a paper sheet with a slitter and then using the paper tape to manufacture a compound paper yarn in a conventional manner, the inventor of the present application has previously considered to process the formed paper tape directly into the compound paper yarn. However, when the paper sheet is slit with the slitter, about 100 to 200 paper tapes are made from one paper sheet. Processing all of these paper tapes one by one simultaneously into the compound paper yarn requires not only preparing a covering machine provided with about 100 to about 200 covering units, the number of which is the same number as the number of paper tapes formed by the slitting, but also an installation space and a work space for individual covering units. Further, in order to supply each paper tape included in the plurality of paper tapes directly to a single covering unit such that each single paper tape is supplied for each single covering unit after the paper sheet is slit by the slitter to form a plurality of paper tapes, it is necessary to convey each single paper tape over a distance of at least about 15 m even if the slitter is arranged at a center where the plurality of covering units are arranged side by side. When a paper tape having a width of about 1 mm to several mm is conveyed in the air, the paper tape may break due to its own weight. In consideration of these, the inventor of the present application has previously repeated various experiments and the like, and as a result, created the invention described in Patent Document 1.

Thereafter, the inventor of the present application has obtained the following knowledge in a process of further conducting experiments with a prototype for practical use. It has been found that, in a conventional covering yarn manufacturing method using a paper tape, only a slight impact has occurred on each paper tape in a process of feeding a single paper tape for each single covering unit. It has been found that a thin and narrow paper tape having small breaking elongation tends to easily break due to this slight impact, but has a certain degree of breaking strength against a static load. In the present specification, the breaking strength is a tensile load value when a test sample is pulled at a speed of 200 mm/min with use of a tensile tester in accordance with ASTM-D-882 or JIS-C-2151 and the sample is broken. For example, in a case of a Japanese paper tape having a basis weight of 10 g/mm$^2$ and a width of 1.2 mm, average breaking strength has been 69.0 gf (0.68 N) and average breaking elongation has been 1.25%. In a case of a Japanese paper tape having a basis weight of 12 g/mm$^2$ and a width of 1.2 mm, average breaking strength has been 94.5 gf (0.93 N) and average breaking elongation has been 1.25%. In a case of a Japanese paper tape having a basis weight of 10 g/mm$^2$ and a width of 1.5 mm, average breaking strength has been 96.5 gf (0.95 N) and average breaking elongation has been 1.88%. In each case, a length of the sample has been 200 mm. In these Japanese paper tapes, measured tension has been from 3 gf (0.029 N) to 10 g (0.098 N), but breakage of the Japanese paper tape has frequently occurred, and an operation rate of a paper yarn manufacturing device has been as low as from 40% to 60%. The inventor of the present application has thought that a reason why the Japanese paper tape breaks at a tension of 3 gf to 10 gf although the average breaking strength of the Japanese paper tape is about 70 gf (about 0.69 N) is because the average breaking elongation of the Japanese paper tape is small. Therefore, as a result of observing a process from formation to supply to the covering unit for each Japanese paper tape, the inventor of the present application has found that the Japanese paper tape breaks when a slight impact is applied in a feeding direction. As a result of studying a cause of occurrence of the slight impact, the inventor of the present application has created the present invention.

An object of the present invention is to provide a novel compound paper yarn manufacturing device and compound paper yarn manufacturing method each including a mechanism that does not apply a slight impact in a feeding direction, that is, a rapid change in tension to each single paper tape when each single paper tape included in a plurality of paper tapes formed by slitting a paper sheet with a slitter is continuously supplied as it is to a covering machine to be processed into a compound paper yarn.

Further, the inventor of the present application has found that a paper portion (only Japanese paper) of a compound paper yarn is less likely to break when the compound paper yarn obtained by the novel compound paper yarn manufacturing device and compound paper yarn manufacturing method is pulled and subjected to a measurement test of breaking strength. Note that, in a compound paper yarn manufactured by a conventional paper yarn manufacturing device, a long fiber portion made of synthetic fibers does not break when pulled, but a paper portion often breaks. When the compound paper yarn in which the paper portion breaks is formed into a woven fabric or a knitted fabric and commercialized, the broken paper portion may be unraveled and appear on a surface of the product. Even if the broken paper portion does not appear on the surface, the appearance of the compound paper yarn is different at the broken paper portion, and unevenness occurs in the appearance of the product. In such a case, a commodity value is impaired. In the conventional compound paper yarn manufacturing device and compound paper yarn manufacturing method, the problem that the paper portion easily breaks in the compound paper yarn has been unable to be solved. Whereas, it has been found that a compound paper yarn manufactured by the novel compound paper yarn manufacturing device and compound paper yarn manufacturing method by the inventor of the present application is less likely to break in a paper portion even when tension is applied.

Means for Solving the Problems

In order to solve the above problems, a compound paper yarn manufacturing device according to the present invention is a compound paper yarn manufacturing device including: a pair of feeding rollers configured to sandwich and feed out a single paper tape at a constant speed; a pair of slip rollers including a driving roller that is rotated at a surface speed of more than 1.000 times as compared with a constant speed of the pair of feeding rollers, and configured to sandwich the single paper tape and feed out the single paper tape while slipping the driving roller with respect to the single paper tape; and a covering machine provided with a single covering unit that has a false-twisting mechanism configured to perform, with a first yarn added, false-twisting on the single paper tape fed out by the pair of slip rollers, and has a covering mechanism configured to cover, with a second yarn, the single paper tape and the first yarn added to the single paper tape in a twisting region or an untwisting region of the false-twisting mechanism. The first yarn is at least one piece of yarn selected from a group including a first long fiber, a first spun yarn, and a compound yarn in which the first long fiber and the first spun yarn are combined, and the second yarn is at least one piece of yarn selected from a group including a second long fiber, a second spun yarn, and a compound yarn in which the second long fiber and the second spun yarn are combined.

Alternatively, a compound paper yarn manufacturing device according to the present invention is a compound paper yarn manufacturing device including: a paper roll on which a long paper sheet is wound in a roll shape; a slitter configured to slit the paper sheet fed out from the paper roll to form a plurality of paper tapes having a narrow width, in a feeding direction of the paper sheet; a pair of feeding rollers configured to sandwich and feed out the plurality of paper tapes formed by the slitter, at a constant speed; a distributor having a plurality of guide paths each provided to allow a single paper tape alone to pass from the plurality of paper tapes conveyed by the pair of feeding rollers, and configured to distribute the plurality of paper tapes into each the single paper tape; a plurality of pairs of slip rollers obtained by providing a plurality of pieces of a pair of slip rollers such that the pair of slip rollers correspond to each the single paper tape distributed from the plurality of paper tapes, in which the pair of slip rollers include a driving roller that is rotated at a surface speed of more than 1.000 times as compared with a constant speed of the pair of feeding rollers and is configured to sandwich the single paper tape distributed by the distributor and feed out the single paper tape while slipping the driving roller with respect to the single paper tape; and a covering machine provided with a plurality of single covering units such that each of the single covering units corresponds to each the single paper tape fed out by the pair of slip rollers, in which each of the single covering units has a false-twisting mechanism configured to perform, with a first yarn added, false-twisting on the single paper tape fed out by the pair of slip rollers, and has a covering mechanism configured to cover, with a second yarn, the single paper tape and the first yarn added to the single paper tape in a twisting region or an untwisting region of the false-twisting mechanism. The first yarn is at least one piece of yarn selected from a group including a first long fiber, a first spun yarn, and a compound yarn in which the first long fiber and the first spun yarn are combined, and the second yarn is at least one piece of yarn selected from a group including a second long fiber, a second spun yarn, and a compound yarn in which the second long fiber and the second spun yarn are combined.

In the compound paper yarn manufacturing device according to the present invention, as compared with a feeding speed of the pair of feeding rollers, a surface speed of the driving roller in the pair of slip rollers may be 1.005 times or more and 1.050 times or less.

In the compound paper yarn manufacturing device according to the present invention, as compared with a feeding speed of the at least one piece of the first yarn, a feeding speed of the single paper tape subjected to false-twisting with the at least one piece of the first yarn added may be 1.05 times or more and 1.35 times or less.

In the compound paper yarn manufacturing device according to the present invention, the pair of slip rollers include the driving roller and a driven roller, and at least one roller selected from a group including the driving roller and the driven roller may have a roller surface subjected to a smoothing process for paper.

In the compound paper yarn manufacturing device according to the present invention, the driving roller and the driven roller may be arranged in a vertical direction in the pair of slip rollers, the driving roller may be arranged below the driven roller, and the driven roller may be arranged above the driving roller.

In the compound paper yarn manufacturing device according to the present invention, in the pair of slip rollers, the driven roller may be arranged to be changeable to a roller having any different weight.

A compound paper yarn manufacturing method according to the present invention is a compound paper yarn manufacturing method including: a step of feeding out a single paper tape; a step of feeding out the fed single paper tape while slipping; a step of performing false-twisting, with a first yarn added, on the single paper tape fed out while being slipped; and a step of covering, with a second yarn, the single paper tape and the first yarn in a twisting region or an untwisting region in the step of performing false-twisting. The first yarn is at least one piece of yarn selected from a group including a first long fiber, a first spun yarn, and a compound yarn in which the first long fiber and the first spun yarn are combined, and the second yarn is at least one piece of yarn selected from a group including a second long fiber, a second spun yarn, and a compound yarn in which the second long fiber and the second spun yarn are combined.

Alternatively, a compound paper yarn manufacturing method according to the present invention is a compound paper yarn manufacturing method including: a step of preparing a paper sheet wound in a roll shape; a step of feeding out the paper sheet in a longitudinal direction; a step of slitting the paper sheet to form a plurality of paper tapes having a narrow width in a feeding direction of the fed paper sheet; a step of distributing the formed plurality of paper tapes into each single paper tape by a distributor; a step of feeding out each the distributed single paper tape while slipping; a step of performing false-twisting, with a first yarn added, on each the single paper tape fed out while being slipped; and a step of covering, with a second yarn, for each combination of the single paper tape and the first yarn in a twisting region or an untwisting region in the step of performing false-twisting. The first yarn is at least one piece of yarn selected from a group including a first long fiber, a first spun yarn, and a compound yarn in which the first long fiber and the first spun yarn are combined, and the second yarn is at least one piece of yarn selected from a group including a second long fiber, a second spun yarn, and a compound yarn in which the second long fiber and the second spun yarn are combined.

A compound paper yarn according to the present invention may be a compound paper yarn manufactured by the compound paper yarn manufacturing device according to the present invention.

Alternatively, a compound paper yarn according to the present invention may be a compound paper yarn manufactured by the compound paper yarn manufacturing device according to the present invention, in which, when the compound paper yarn is cut to a predetermined length, as compared with a length of the first yarn included in a formed section of the compound paper yarn, a length of the single paper tape included in the section of the compound paper yarn is 1.05 times or more and 1.35 times or less.

Alternatively, a compound paper yarn according to the present invention may be a compound paper yarn formed by covering, with a second yarn, a fiber bundle formed by performing false-twisting on a single paper tape and a first yarn added to the single paper tape, in which, when the compound paper yarn is cut to a predetermined length, as compared with a length of the first yarn included in a formed section of the compound paper yarn, a length of the single paper tape included in the section of the compound paper yarn is 1.05 times or more and 1.35 times or less. The distributor in the compound paper yarn manufacturing device according to the present invention is preferably provided with a plurality of guide paths such that one of the guide paths corresponds to each single paper tape included in the plurality of paper tapes. In the compound paper yarn manufacturing device according to the present invention, the compound paper yarn manufacturing method according to the present invention, and the compound paper yarn according to the present invention, the first yarn is preferably at least one piece of the first long fiber, and more preferably one piece of the first long fiber. In the compound paper yarn manufacturing device according to the present invention, the compound paper yarn manufacturing method according to the present invention, and the compound paper yarn according to the present invention, the second yarn is preferably at least one piece of the second long fiber, and more preferably one piece of the second long fiber.

Effects of the Invention

According to an example of the compound paper yarn manufacturing device and the compound paper yarn manufacturing method according to the present invention, a single paper tape is fed at a constant speed by the pair of feeding rollers, and the pair of slip rollers rotated at a surface speed higher than a speed of the single paper tape feed the single paper tape to the single covering unit while slipping the single paper tape. The driving roller of the pair of slip rollers is rotated at a surface speed of, as compared with a feeding speed (constant speed) of the feeding roller, more than 1.000 times, preferably 1.005 times or more and 1.050 times or less, and more preferably 1.008 times or more and 1.025 times or less. The feeding speed of the pair of slip rollers refers to a surface speed of the driving roller. When rotation is made at the feeding speed of the pair of slip rollers of the surface speed more than 1.000 times and preferably more than 1.005 times as compared with the feeding speed of the feeding rollers, the single paper tape is hardly to break. The single paper tape is fed out in a state of always being slipped between the pair of slip rollers, and a rapid slight impact (rapid change in tension) in a feeding direction is hardly applied to the single paper tape. Therefore, in a process of processing the single paper tape into a compound paper yarn, the single paper tape is hardly to break, the single paper tape can be smoothly supplied to the single covering unit provided in the covering machine, and the compound paper yarn is smoothly manufactured.

According to another example of the compound paper yarn manufacturing device and the compound paper yarn manufacturing method according to the present invention, a paper sheet fed out from a paper roll is slit by the slitter to form a plurality of paper tapes. The formed plurality of paper tapes are fed out at a constant speed by the pair of feeding rollers. The fed plurality of paper tapes are distributed into each single paper tape by the distributor. For each single covering unit, one distributed paper tape is supplied via the pair of slip rollers. The driving roller of the pair of slip rollers is rotated at a surface speed of, as compared with a feeding speed (constant speed) of the feeding roller, more than 1.000 times, preferably 1.005 times or more and 1.050 times or less, and more preferably 1.008 times or more and 1.025 times or less. The feeding speed of the pair of slip rollers refers to a surface speed of the driving roller. When rotation is made at the feeding speed of the pair of slip rollers of the surface speed more than 1.000 times and preferably more than 1.005 times as compared with the feeding speed of the feeding rollers, each single paper tape is hardly to break. Each single paper tape is fed out in a state of always being slipped between the pair of slip rollers, and a rapid slight impact (rapid change in tension) in a feeding direction is hardly applied to each single paper tape. Therefore, in a process of processing each single paper tape included in the plurality of paper tapes into the compound paper yarn, each single paper tape is hardly to break, the single paper tape can be smoothly supplied for each single covering unit provided in the covering machine, and the compound paper yarn is smoothly manufactured.

When rotation is made at the feeding speed of the pair of feeding rollers of a high speed of, as compared with a feeding speed of the first yarn (a feeding speed of a delivery roller), 1.05 times or more and 1.35 times or less, preferably 1.10 times or more and 1.20 times or less, more preferably 1.14 times or more and 1.17 times or less, and even more preferably 1.145 times or more and 1.165 times or less, overfeeding is likely to occur such that a length of the paper tape is 1.05 times or more and 1.35 times or less as compared with a length of the first yarn. In the compound paper yarn obtained by overfeeding in this manner, breakage of only a paper portion (paper tape) is to hardly occur when the first yarn is pulled to such an extent that the first yarn does not break. Since a constant tension is always applied to the paper tape by the pair of slip rollers to feed out, the obtained compound paper yarn is evenly false-twisted and covered.

For the reason described above, in another compound paper yarn manufacturing device and another compound paper yarn manufacturing method according to the present invention, as compared with the conventional art, a series of operations from feeding out the paper sheet to obtaining the compound paper yarn can be easily performed without interruption until the paper sheet of the paper roll is completely fed out and runs out. In this compound paper yarn manufacturing device, in principle, it is possible to continue to manufacture the compound paper yarn until the paper sheet of the paper roll runs out without temporarily stopping the compound paper yarn manufacturing device even when, for example, several paper tapes of the plurality of paper tapes break. Therefore, since there is almost no room for a worker to perform work during this series of work, labor saving can be achieved. Further, in the compound paper yarn manufacturing device and the compound paper yarn manufacturing method according to the present invention, since a plurality of paper tapes formed by slitting a paper sheet are continuously distributed into each single paper tape after formation and processed into a compound paper yarn by false-twisting and covering, time required to obtain the compound paper yarn from the paper sheet can be significantly shortened, and the manufacturing cost of the compound paper yarn can be significantly reduced, as compared with a manufacturing device and a manufacturing method in which a paper tape formed by slitting a paper sheet is once wound and then used to manufacturing of a compound paper yarn as in the conventional art.

For the reason described above, in the compound paper yarn manufacturing device and the compound paper yarn manufacturing method according to the present invention, the paper tape can always be stably supplied by the pair of slip rollers, and the single paper tape, the first yarn, and the second yarn can always be stably supplied for each single covering unit. Therefore, the paper tape and the first yarn are easily and evenly false-twisted over the longitudinal direction, and are easily and evenly covered with the second yarn over the longitudinal direction. Therefore, in the manufactured compound paper yarn according to the present invention, local unevenness is less likely to occur over the longitudinal direction.

In the compound paper yarn according to the present invention, when cut at a predetermined length, it is desirable that, as compared with a length of the first yarn included in a formed section of the compound paper yarn, a length of the single paper tape included in the section of the compound paper yarn is set to preferably 1.05 times or more and 1.35 times or less, more preferably 1.10 times or more and 1.20 times or less, even more preferably 1.14 times or more and 1.17 times or less, and further more preferably set to 1.145 times or more and 1.165 times or less. In the compound paper yarn according to the present invention manufactured as described above, when pulled, the paper tape is stretched straight by an overfeed amount within a range in which the first yarn is stretched, which almost eliminates breakage of only the paper tape. Since the compound paper yarn according to the present invention is evenly twisted over the longitudinal direction as described above, breakage of only the paper tape hardly occurs even if the compound paper yarn is locally pulled at a short distance.

BRIEF DESCRIPTION OF THE DRAWINGS

FIGS. 1A and 1B are views illustrating a schematic configuration of a compound paper yarn manufacturing device according to an embodiment of the present invention, in which FIG. 1A is a front view and FIG. 1B is a plan view.

FIGS. 2A and 2B are schematic explanatory views of a slitter provided in the compound paper yarn manufacturing device according to the embodiment of the present invention, in which FIG. 2A is a front view and 2B is a plan view. In the figure, a comb-shaped sensor provided together with the slitter is also illustrated.

FIGS. 5A and 5B are explanatory views of each pair of slip rollers included in a plurality of pairs of slip rollers provided in the compound paper yarn manufacturing device according to the embodiment of the present invention, in which FIG. 5*a* is a front view and FIG. 5B is a side view. In the figure, a tube that supplies a core yarn is also illustrated.

BEST MODE FOR CARRYING OUT THE INVENTION

Hereinafter, an embodiment of a compound paper yarn manufacturing device according to the present invention will be described with reference to the drawings. Hereinafter, in the present specification, an embodiment in a case where Japanese paper is used as paper will be described, but an embodiment in a case where other paper such as Western paper is used is not excluded from the present invention.

[Schematic Configuration of Compound Paper Yarn Manufacturing Device]

Figure 1A:
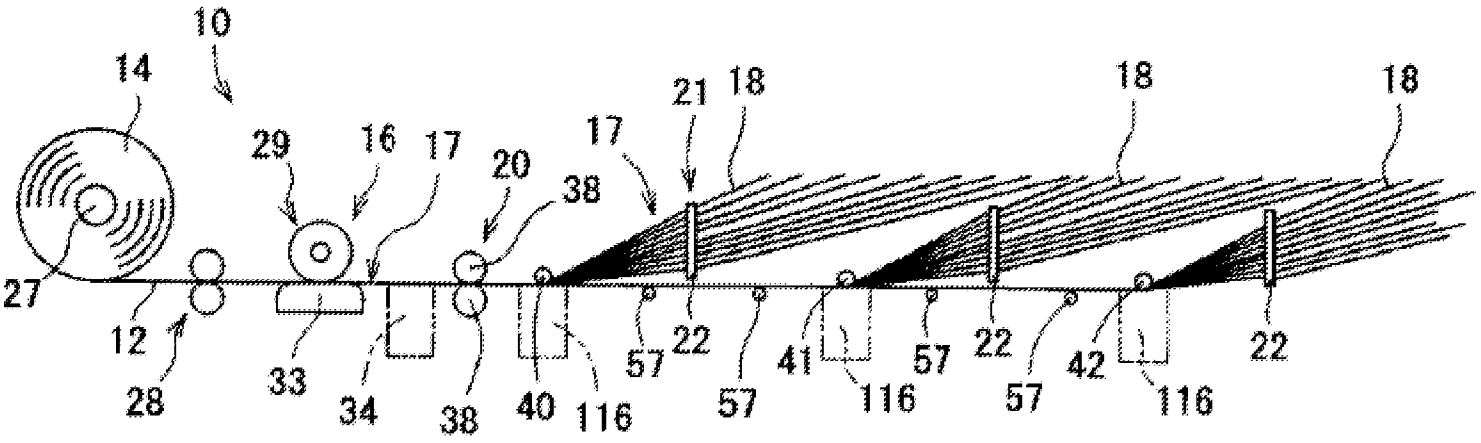
Figure 1B:
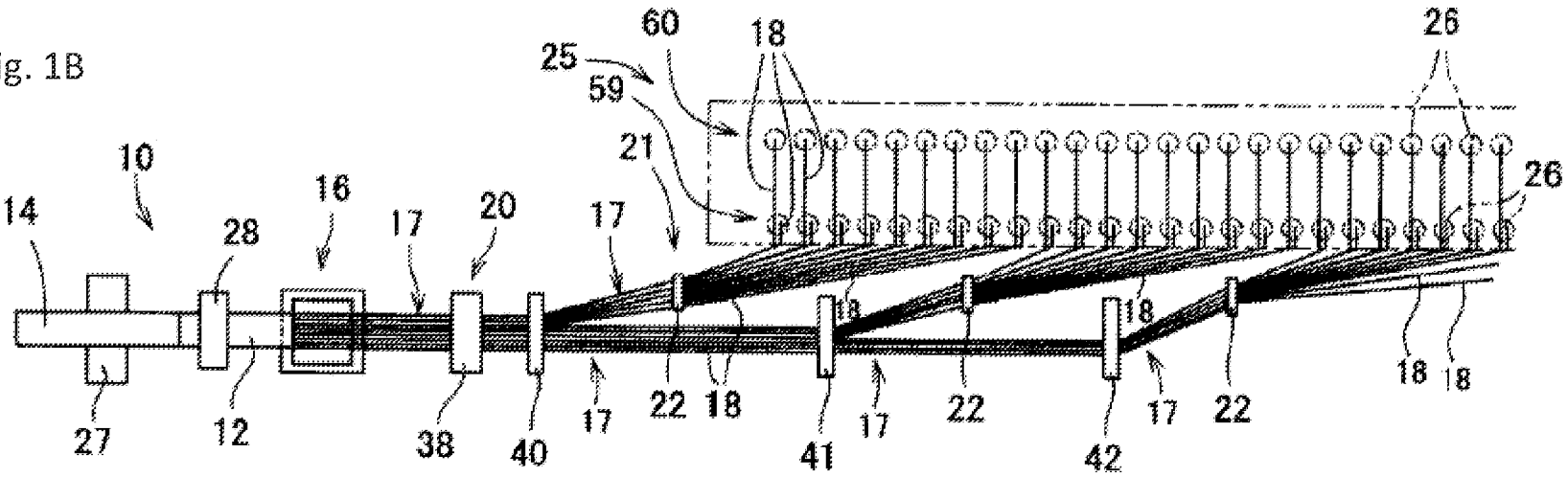
Figure 5A:
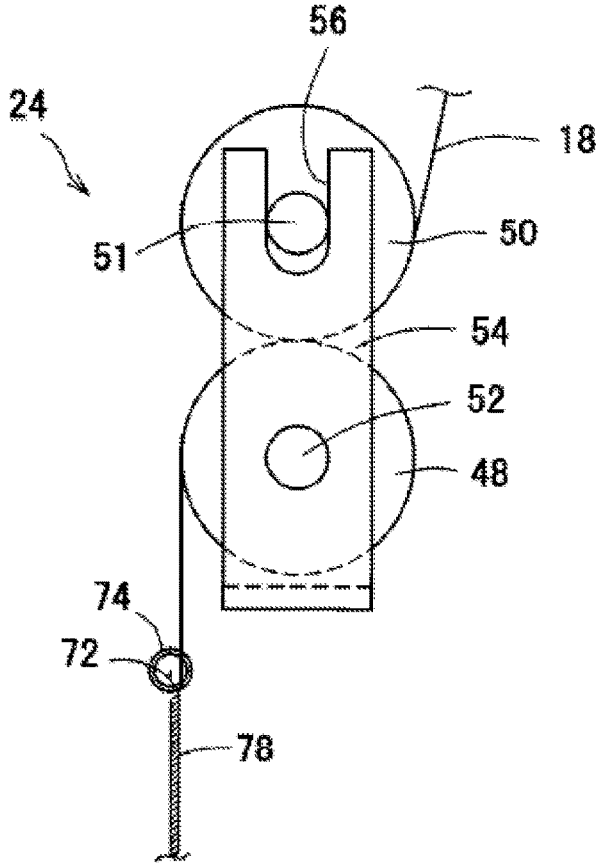
Figure 5B:
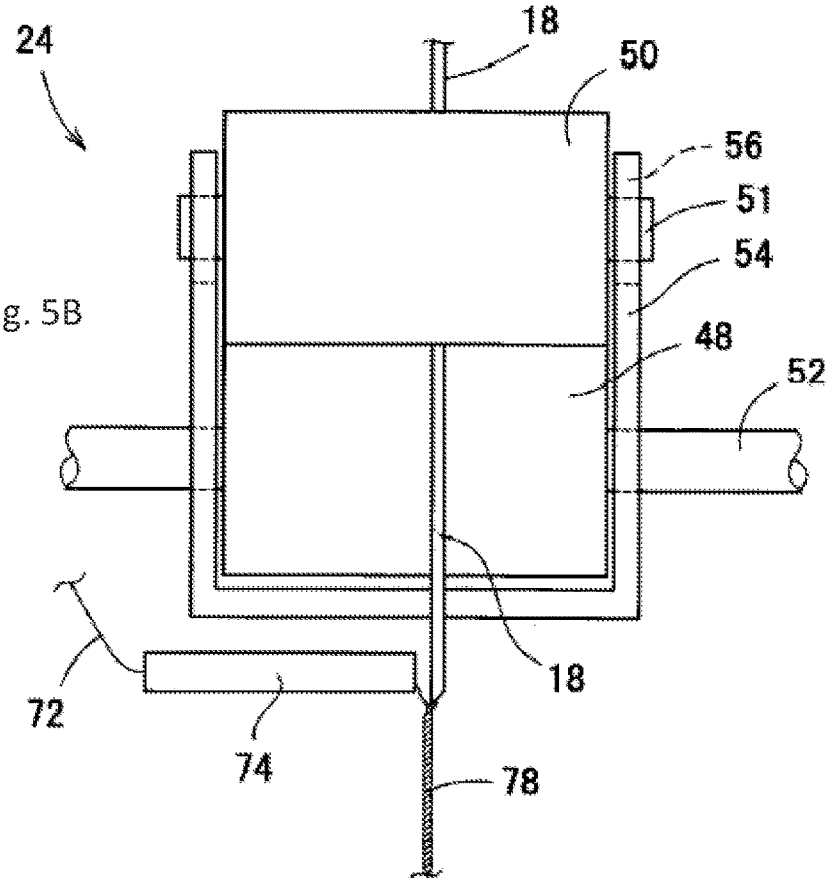
Figure 6:
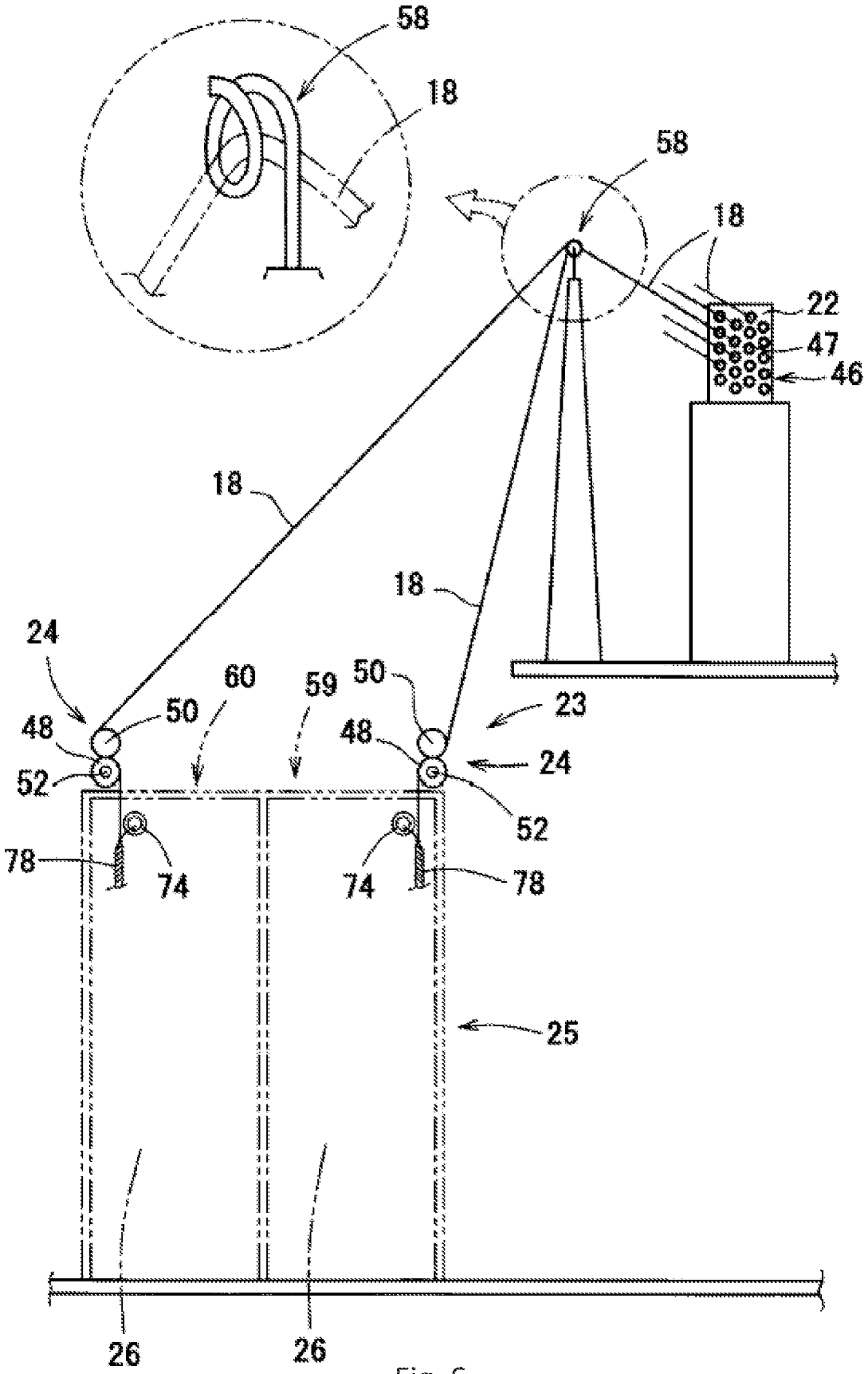
FIG. 6 is an enlarged explanatory view of a main part illustrating an example of arrangement of a yarn path member in a distributor included in the compound paper yarn manufacturing device according to the embodiment of the present invention and each covering unit provided to a covering machine.
Figure 7:
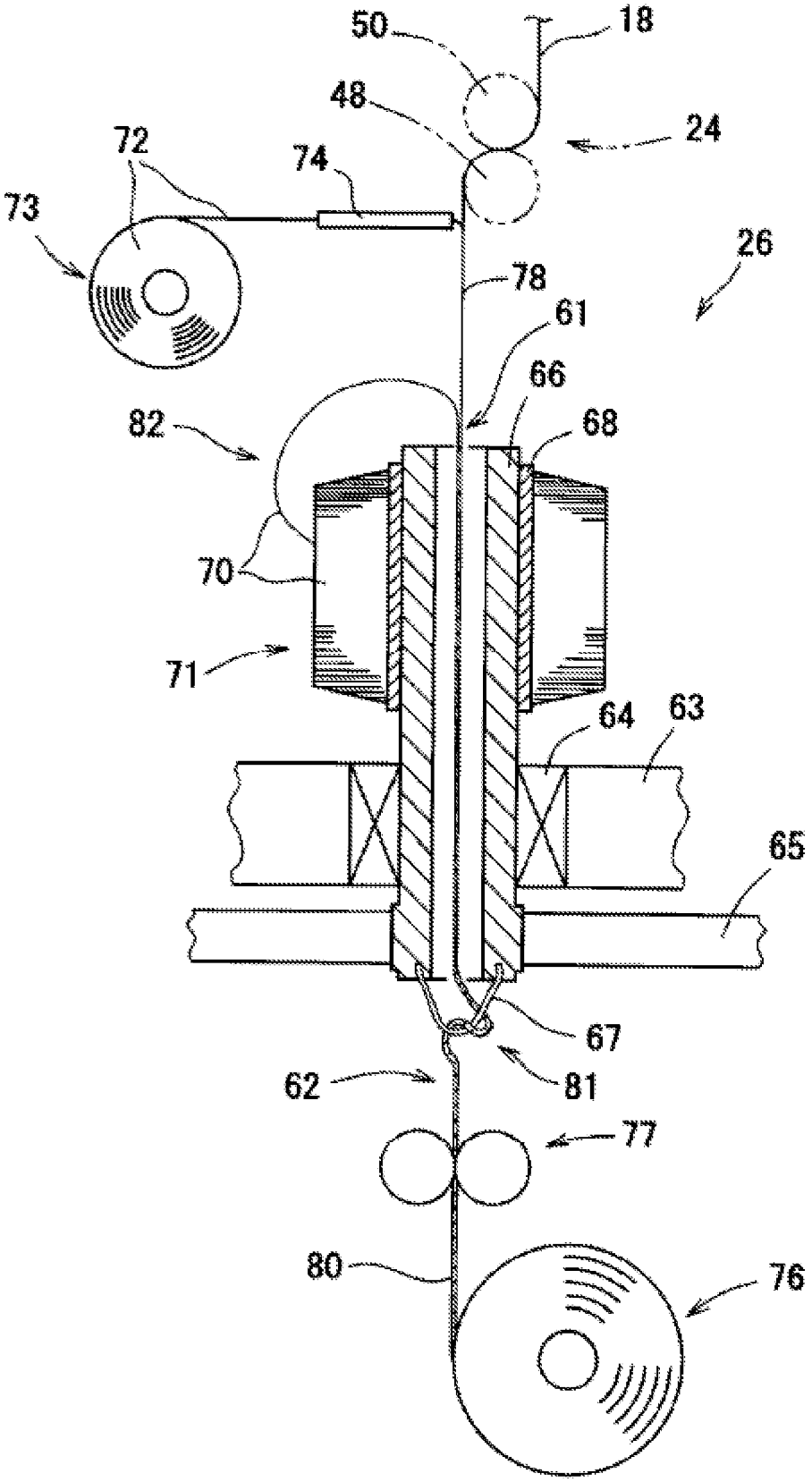
FIG. 7 is an explanatory view illustrating a schematic configuration of an example of each covering unit provided to a covering machine included in the compound paper yarn manufacturing device according to the embodiment of the present invention.

As illustrated in FIGS. 1A and 1B, a compound paper yarn manufacturing device 10 according to an embodiment of the present invention includes a Japanese paper roll 14, a slitter 16, a pair of feeding rollers 20, a distributor 21, a plurality of pairs of slip rollers 23 (see FIG. 6) not illustrated in FIGS. 1A and 1B, and a covering machine 25. The Japanese paper roll 14 is obtained by winding along Japanese paper sheet 12 into are shape. The slitter 16 is arranged so as to slit the Japanese paper sheet 12 fed out from the Japanese paper roll 14 and form a plurality of Japanese paper tapes 17 in a feeding direction of the Japanese paper sheet 12. The pair of feeding rollers 20 are arranged so as to sandwich and convey the plurality of Japanese paper tapes 17. The distributor 21 distributes the plurality of Japanese paper tapes 17 fed out by the pair of feeding rollers 20, into each single Japanese papertape 18. The plurality of pairs of slip rollers 23 illustrated in FIG. 6 are obtained by providing a plurality of pieces of the pair of slip rollers 24 illustrated in FIG. 5. Each pair of slip rollers 24 convey the distributed each single Japanese paper tape 18 while sandwiching (nipping) in a slidable manner. The covering machine 25 illustrated in FIGS. 1A and 1B is provided with a plurality of covering units. As illustrated in FIG. 7, each covering unit 26 includes: a false-twisting mechanism 81 that performs false-twisting, with a first yarn 72 added, on the single Japanese paper tape 18 fed from the pair of slip rollers 24; and a covering mechanism 82 that covers, with a second yarn 70, the single Japanese paper tape 18 and the first yarn 72.

[Paper]

The paper used in the present invention is not particularly limited to so-called Western paper, Japanese paper, or the like as long as it can be processed into a yarn shape by being slit to a narrow width and then twisted. The paper used in the present invention is preferably Japanese paper from the viewpoint of paper having a small paper thickness, a narrow width, and a large breaking strength.

Japanese paper is paper made by straining a Japanese paper raw material in a slurry form mainly containing fibers obtained by beating a raw material plant suitable for Japanese paper. Examples of the raw material plant suitable for Japanese paper include one or more plants selected from a group including kozo, paper bush, ganpi, hemp, conifers, hardwoods, bamboo grass, and the like. A basis weight of Japanese paper is preferably in a range of about 8 $g/m^2$ or more and about 30 $g/m^2$ or less from the viewpoint of ease of manufacturing, but one having a large basis weight exceeding this range and one having a small basis weight exceeding this range can also be used. The Japanese paper used in the present invention may contain raw material fibers derived from a material other than the Japanese paper raw material described above as long as it is 20 mass % or less. From the viewpoint of maintaining hygroscopicity and strength peculiar to Japanese paper, a content of fibers derived from a material other than the Japanese paper raw material is preferably suppressed to 20 mass % or less, in the Japanese paper used in the present invention. From the viewpoint of maintaining hygroscopicity and strength peculiar to Japanese paper, a content of fibers derived from the Japanese paper raw material is preferably 90 mass % or more, in the Japanese paper used in the present invention.

A width and a length of the Japanese paper sheet 12 used in the present invention are not particularly limited as long as they do not contradict the object of the present invention. As the Japanese paper sheet 12, for example, long sheet-shaped Japanese paper having a width of about 120 mm or more and 500 mm or less and a length of about 10,000 m or more and 50,000 m or less can be preferably mentioned. The Japanese paper sheet 12 is manufactured such that a direction of the fibers of the Japanese paper raw material is oriented in a longitudinal direction as much as possible, and thus is formed to be relatively easily torn for a tensile force in a width direction, but is considerably strong and hardly torn for a tensile force in the longitudinal direction. Therefore, in the plurality of Japanese paper tapes 17 formed by slitting the Japanese paper sheet 12 in the longitudinal direction, even when each single Japanese paper tape 18 has a width of about 0.8 mm or more and about 30 mm or less, it is difficult to break with respect to a tensile force in the longitudinal direction as compared with a tape made of paper (Western paper) in which orientation directions of raw material fibers are random.

The long Japanese paper sheet 12 is wound around a roller 27 into a roll shape to form the Japanese paper roll 14. The roller 27 is installed in a bearing (not illustrated), and the Japanese paper sheet 12 is smoothly fed out from the Japanese paper roll 14. A configuration may be adopted in which the roller 27 or the bearing may be connected to a device (not illustrated), and the roller 27 may be rotated by a driving force of the driving device to allow the Japanese paper sheet 12 to be smoothly fed out from the Japanese paper roll 14. Alternatively, a configuration may be adopted in which the Japanese paper roll 14 is placed on two rotation rolls parallel to each other, and the Japanese paper sheet 12 can be fed out from the Japanese paper roll 14 by rotating the two rotation rolls. Alternatively, a configuration is preferably adopted in which the Japanese paper sheet 12 is sandwiched (nipped) by a pair of sending rollers 28 illustrated in FIGS. 1A and 1B connected to a driving device (not illustrated), and the Japanese paper sheet 12 can be fed out from the Japanese paper roll 14.

[Slitter]

Figure 2A:
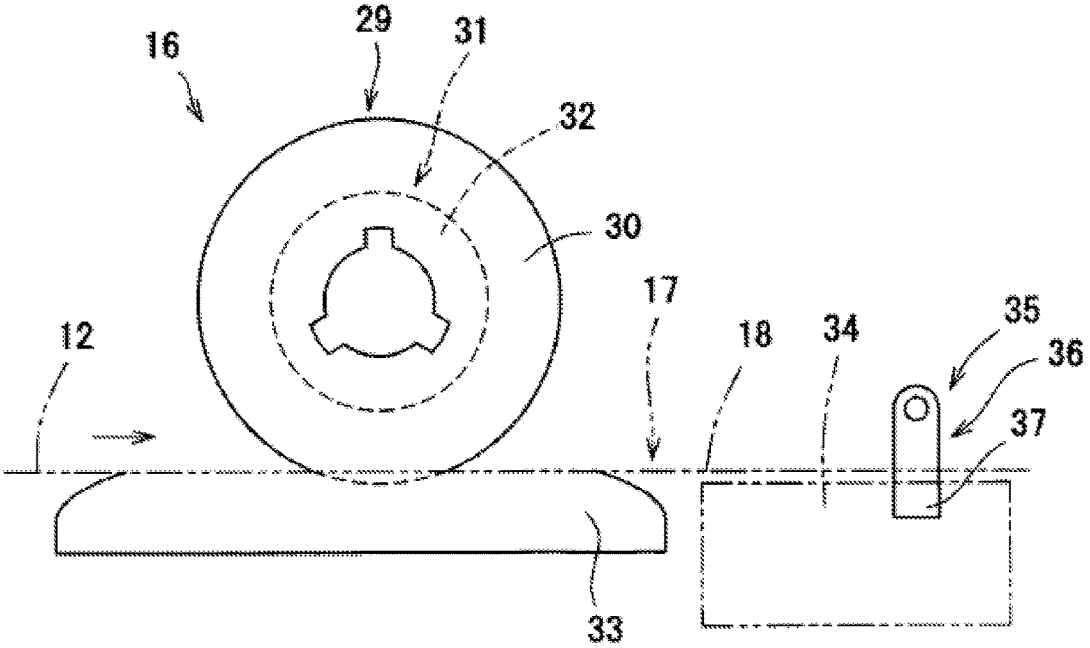
Figure 2B:
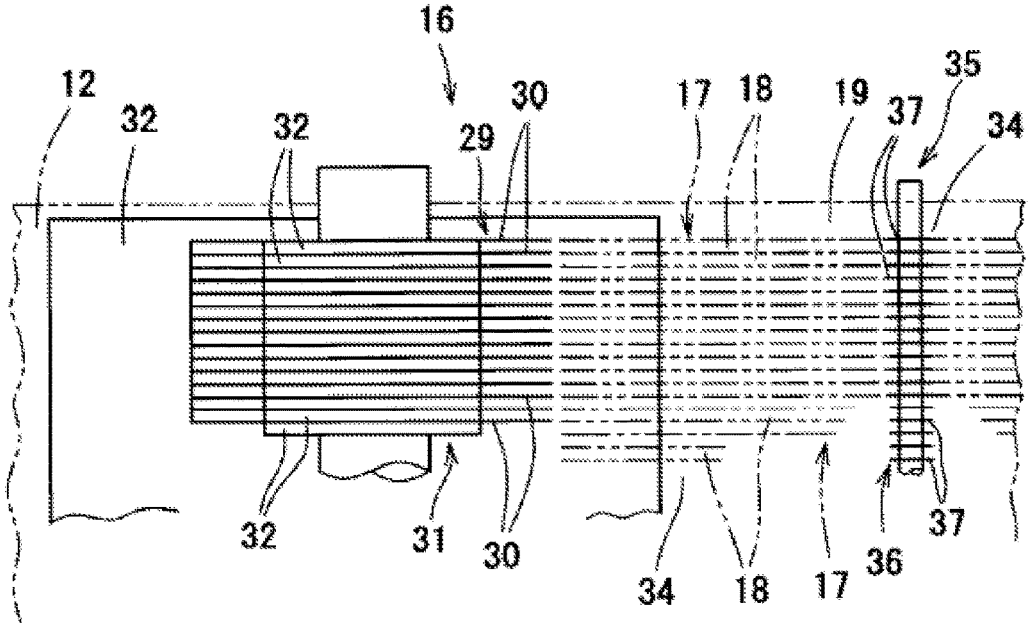

As illustrated in FIGS. 2A and 2B, the slitter 16 includes: a plurality of disk-shaped rotary blades 29; and a flat plate-shaped opposing member 33 provided to be in contact with or slightly bitten by cutting edges of the plurality of disk-shaped rotary blades 29. In the plurality of Japanese paper tapes 17 formed by slitting the Japanese paper sheet 12, for example, in a case where a width of each single Japanese paper tape 18 is 1.5 mm and the number of Japanese paper tapes 18 is 120, 121 pieces of rotary blade 30 included in the plurality of rotary blades 30 are arranged at a pitch of 1.5 mm. Each rotary blade 30 has an outer periphery forming a sharp blade with a razor-shaped thin steel plate or the like. A thickness of each rotary blade 30 is not limited, but for example, when an interval between adjacent rotary blades 30 and 30 is a 1.5 mm pitch, one spacer 32 is interposed between the adjacent rotary blades 30 and 30 for adjustment. The plurality of rotary blades 29 are rotated by a driving device (not illustrated), and smoothly slit the Japanese paper sheet 12 conveyed between the plurality of rotary blades 29 and the opposing member 33. A diameter of each rotary blade 30 is not particularly limited, but is preferably, for example, about 30 mm or more and 60 mm or less. Since at least the cutting edges of the plurality of rotary blades 29 are brought into contact with the opposing member 33, the opposing member is preferably made of a resin material that makes it difficult to wear the cutting edges. The entire opposing member 33 may be made of a resin material, or only an upper portion that comes into contact with the cutting edges of the plurality of rotary blades 29 may be made of a resin material. A shape of the opposing member 33 may be a flat plate shape as illustrated in FIGS. 2A and 2B, but is not particularly limited. For example, when the opposing member has a cylindrical shape or columnar shape, the opposing member can be configured to rotate together with the plurality of rotary blades 29.

In the plurality of Japanese paper tapes 17 formed by slitting the Japanese paper sheet 12 by the slitter 16, a pitch between the rotary blades 30 and 30 is set such that a width of each single Japanese paper tape 18 falls within a range of about 0.8 mm or more and about 30 mm or less. A sum of thicknesses of the plurality of rotary blades 29 and thicknesses of a plurality of spacers 31 corresponds to a width of the plurality of Japanese paper tapes 17. Therefore, when changing a width of each single Japanese paper tape 18, a thickness of each spacer 32 included in the plurality of spacers 31 is changed. For example, in order to obtain 120 pieces of Japanese paper tape 17 from one Japanese paper sheet 12, each rotary blade 29 and each spacer 32 are alternately arranged by an amount corresponding to the 121 pieces of rotary blade 30 and the 120 pieces of spacers 31. Each spacer 32 may be changed to one having an appropriate width according to a pitch between rotary blades 30 and 30, and a spacer 32 having a constant width may be used.

From the viewpoint of stably slitting the Japanese paper sheet 12, when the Japanese paper sheet 12 is slit by the slitter 16, both side portions of the Japanese paper sheet 12 are preferably treated as two selvage portions 19 that are not included in the plurality of Japanese paper tapes 17. From the similar viewpoint, a width of each selvage portion in the two selvage portions 19 is preferably about at least 3 mm or more and 6 mm or less. Both side portions of the Japanese paper sheet 12 are preferably collected as unnecessary two selvage portions 19 and reused as a raw material of new Japanese paper.

An interval at which the Japanese paper sheet 12 is slit by the slitter 16, that is, a width of each single Japanese paper tape 18 included in the plurality of Japanese paper tapes 17 may be all constant, but is not particularly limited. For example, it is also possible to simultaneously form a Japanese paper tape having a width of 1 mm and a Japanese paper tape having a width of 2 mm. In this case, two types of compound paper yarns having different widths of the used Japanese paper tapes are simultaneously manufactured.

[Paper Dust Suction Device]

From the viewpoint of avoiding a problem described below, it is preferable to provide a paper dust suction device 34 in the vicinity of the slitter 16. When the Japanese paper sheet 12 is slit by the slitter 16, a considerable amount of fine paper dust is generated and accumulated on surfaces of peripheral frames and other members. If the paper dust is left, the Japanese paper tape 18 may break due to the accumulated paper dust, or other troubles may be caused in the compound Japanese paper yarn manufacturing device. The paper dust suction device 33 can also be used in common in a case where a broken Japanese paper tape discharging device to be described later is a suction type. The paper dust suction device 34 also has a function of removing a broken Japanese paper tape. That is, in a case where the Japanese paper sheet 12 has a hole such as a pinhole, the Japanese paper tape is broken at a location where the hole is formed, when the Japanese paper sheet 12 is slit by the slitter 16. The paper dust suction device 34 suctions and removes such a broken Japanese paper tape.

[Comb-Shaped Sensor]

It is preferable to provide a comb-shaped sensor 35 around a position where the plurality of Japanese paper tapes 17 formed by the slitter 16 are fed out immediately after being formed. The comb-shaped sensor 35 includes: a plurality of plates 36 that are inserted between individual single Japanese paper tapes 18 included in the plurality of Japanese paper tapes 17 and inserted between the plurality of Japanese paper tapes 18 and the selvage portion 19. Each plate 37 included in the plurality of plates 36 preferably has a thickness of about 0.1 mm or more and 0.5 mm or less, and is rotatably attached to one shaft. On a side portion of each of the plurality of plates 36, an optical sensor (not illustrated) is arranged, and the optical sensor is configured to operate when at least one plate 37 in the plurality of plates 36 is rotated to block light. While the plurality of Japanese paper tapes 17 are formed by slitting the Japanese paper sheet 12 by the slitter 16, adjacent Japanese paper tapes 18 can be completely separated from each other by the plurality of plates 36 even if the adjacent Japanese paper tapes 18 are not completely separated from each other. When a portion that is not completely slit from the Japanese paper sheet 12 to the plurality of Japanese paper tapes 17 is generated due to wear or the like of any of the rotary blades 30, the portion that is not slit hits any plate 37 included in the plurality of plates 36, and the any hit plate 37 is rotated to operate the comb-shaped sensor 35 to stop the compound Japanese paper yarn manufacturing device. In a case of being stopped in this way, it is preferable to replace the slitter 16 with a new one or adjust an interval between the cutting edges of the plurality of rotary blades 29 and the opposing member 33, and then restart the operation of the compound Japanese paper yarn manufacturing device.

[Feeding Roller]

Figure 3:
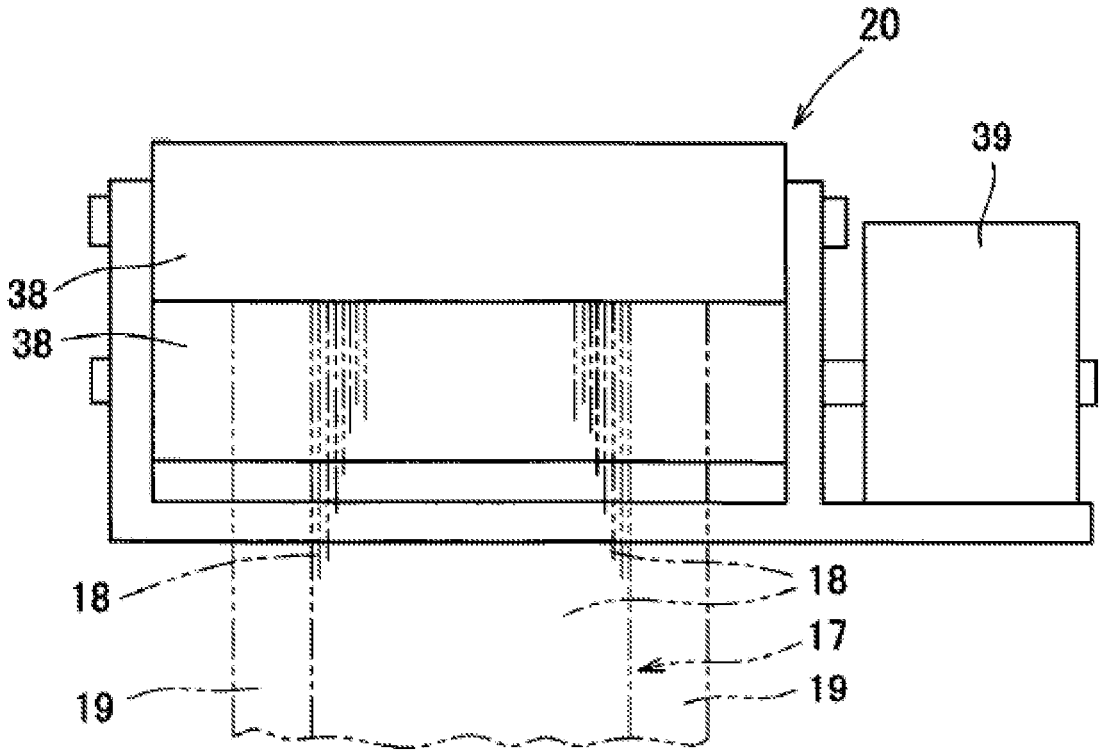
FIG. 3 is a side view illustrating an example of a pair of feeding rollers provided in the compound paper yarn manufacturing device according to the embodiment of the present invention.

As illustrated in FIGS. 1A and 1B, the Japanese paper sheet 12 fed out from the Japanese paper roll 14 is slit by the slitter 16. Each single Japanese paper tape 18 included in the plurality of Japanese paper tapes 17 formed by the slitting is fed at a constant speed by the pair of feeding rollers 20. That is, the Japanese paper sheet 12 is drawn out from the Japanese paper roll 14 by the pair of feeding rollers 20, and is slit by the slitter 16 in a process of reaching the feeding roller 20 from the Japanese paper roll 14. The plurality of Japanese paper tapes 17 and the two selvage portions 19 (see FIGS. 2A and 2B) formed by the slitting are sandwiched (nipped) and fed out by the pair of feeding rollers 20. As illustrated in FIG. 3, the pair of feeding rollers 20 are configured to be driven by a driving device 39 with a speed reducer. From the viewpoint of reliably conveying each single Japanese paper tape 18 included in the plurality of Japanese paper tapes 17, a surface of each roller 38 of the pair of feeding rollers 20 is preferably formed of rubber, resin, or the like. From the similar viewpoint, in the pair of feeding rollers 20, it is preferable that the individual rollers 38 are pressed by a spring or the like so as to be in close contact with each other. The two selvage portions 19 (see FIGS. 2A and 2B) fed out from the pair of feeding rollers 20 are collected and removed.

[Distributor]

From the viewpoint of facilitating distribution of each single Japanese paper tape included in the plurality of Japanese paper tapes 17 one by one later, it is preferable to divide a bundle formed of the plurality of Japanese paper tapes 17 fed out from the pair of feeding rollers 20, for example, as illustrated in FIG. 1B. For example, in a case where 120 pieces of Japanese paper tape 17 are formed from the Japanese paper sheet 12, it is preferable to divide the 120 pieces into three bundles of 40 pieces each. As an example of the division, it is preferable to press a bundle formed of 120 pieces of Japanese paper tape 17 by a first pressing roller 40 and take out 40 pieces from the 120 pieces of Japanese paper tape 17, feed a bundle formed of the remaining 80 pieces of Japanese paper tape 17 and press by a second pressing roller 41 to take out 40 pieces of Japanese paper tape 17, and feed a bundle formed of the remaining 40 pieces of Japanese paper tape 17 and press by a third pressing roller 42 to take out the 40 pieces. As another example of the division, the 120 pieces of Japanese paper tape 17 may be divided into four bundles of 30 pieces each. How to divide the plurality of Japanese paper tapes 17 is not particularly limited. Each of the pressing rollers (40, 41, and 42) is for pressing an upper surface of a bundle formed of the plurality of Japanese paper tapes 17 to take out a bundle of a predetermined number of pieces, and is configured to be freely rotatable so as not to apply a load to the plurality of Japanese paper tapes 17. On a lower surface side of the bundle formed of the plurality of Japanese paper tapes 17, a roller facing each of the pressing rollers (40, 41, and 42) may be further provided, or may not be provided, Instead of each of the pressing rollers (40, 41, and 42), a comb-shaped member capable of dividing a bundle formed of the plurality of Japanese paper tapes 17 may be provided.

For example, the distributor 21 has a plurality of yarn path members, and 40 pieces of Japanese paper tape 17 taken out from the bundle formed of the plurality of Japanese paper tapes 17 are distributed one by one by one yarn path member 22. For this purpose, for example, a plurality of holes (a plurality of guide paths) 46 are formed in a plate 44, in each yarn path member 22 illustrated in FIG. 4. For example, at least 40 holes (a plurality of guide paths) 46 are formed in the plate 44 of the yarn path member 22. Arrangement of individual holes (individual guide paths) 47 in a horizontal direction is shifted by a width W in accordance with the width W of the each single Japanese paper tape 18. Therefore, each single Japanese paper tape 18 included in the plurality of Japanese paper tapes 17 is inserted straight into one hole (one guide path) 47 without being bent in the horizontal direction. Arrangement of the individual holes (individual guide paths) 47 in a vertical direction is not limited, but arrangement is made such that adjacent individual single Japanese paper tapes 18 do not come into contact with each other. It is preferable that a protective member made of a material having a low frictional resistance with the Japanese paper tape 18 and being less likely to be worn by contact with the Japanese paper tape 18 is embedded in an inner peripheral surface of each hole (each guide path) 47. Preferable examples of the material of the protective member include ceramics and a hard resin.

The single Japanese paper tape 18 is inserted into each hole (each guide path) 47 provided in the yarn path member 22 in the distributor 21. For example, a bundle formed of 40 pieces of Japanese paper tape 17 is inserted through the individual holes (individual guide paths) 47 provided in the yarn path member 22 in order from bottom to top so as to correspond to an arrangement order of each single Japanese paper tape 18. While the bundle formed of the plurality of Japanese paper tapes 17 is planar, it is possible to avoid breakage due to entanglement or contact between the Japanese paper tapes 18, by distributing each single Japanese paper tape 18 included in the bundle in any one of the upper, lower, left, and right directions by each hole (each guide path) 47 provided in the yarn path member 22. In this manner, the plurality of Japanese paper tapes 17 are distributed into each single Japanese paper tape 18 by the distributor 21. The distributed each single Japanese paper tape 18 is fed to the single covering unit 26 via the pair of slip rollers 24 illustrated in FIGS. 5A and 5B.

Figure 4:
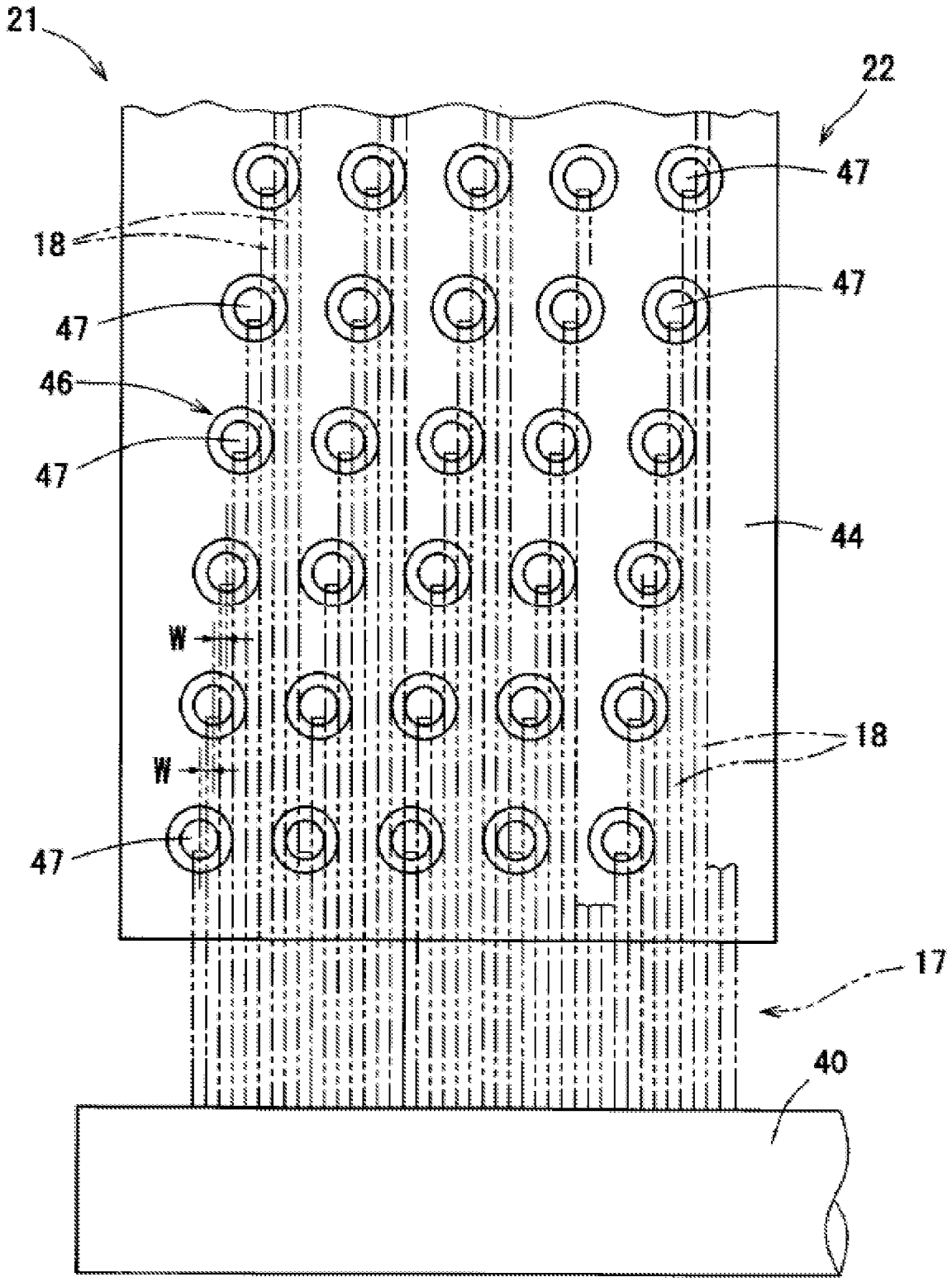
FIG. 4 is an explanatory view illustrating a schematic configuration of a yarn path member in a distributor included in the compound paper yarn manufacturing device according to the embodiment of the present invention. In order to show a usage example of the yarn path member in the distributor, a plurality of paper tapes and a pressing roller are also illustrated.

In the distributor 21, the plurality of holes (the plurality of guide paths) 46 are preferably provided such that one hole (one guide path) 47 corresponds to each single Japanese paper tape 18 included in the plurality of Japanese paper tapes 17. The distributor 21 is not limited to one including a plurality of yarn path members 22 as illustrated in FIGS. 1A and 1B, and may also be one including one yarn path member 22. The distributor 21 is not limited to one including the yarn path member 22 in which the plurality of holes (the plurality of guide paths) 46 are provided in the plate 44 as illustrated in FIG. 4, and may be, for example, one in which a plurality of direction changing jigs are arranged on the plate 44 or comb-shaped teeth are provided on the plate 44, instead of the plurality of holes (the plurality of guide paths) 46. Each of the direction changing jigs is not particularly limited as long as it does not contradict the object of the present invention, and examples thereof include a snail wire.

[Slip Roller]

As each pair of slip rollers 24 included in the plurality of pairs of slip rollers 23 illustrated in FIG. 6, the same number of pairs are prepared so as to correspond to the number of Japanese paper tapes 18 included in the plurality of Japanese paper tapes 17 illustrated in FIGS. 1 and 2. As illustrated in FIGS. 5A and 5B, each pair of slip rollers 24 include a driving roller 48 and a driven roller 50 arranged in a vertical direction. In each pair of slip rollers 24, the driving roller 48 is arranged below the driven roller 50, and the driven roller 50 is arranged above the driving roller 48 so as to be driven in contact with a roller surface of the driving roller 48. The driving roller 48 is driven by a driving device (not illustrated). For example, a plurality of pairs of slip rollers may be arranged in a row so as to correspond to a plurality a covering units arranged in a row. It is preferable to provide one drive shaft 52 such that the individual driving rollers 48 included in the plurality of pairs of slip rollers are collectively driven by one driving device. The drive shaft 52 is attached to a bearing (not illustrated) arranged on an attachment member 54, and the driving roller 48 is rotationally driven by the drive shaft 52. The driven roller 30 is attached to a U-shaped bearing 36 formed on the attachment member 54 so as to be movable in a vertical direction. A shaft 51 of the driven roller 50 is configured not to abut against a U-shaped bottom of the bearing 36. Therefore, the shaft 31 of the driven roller 50 is not supported by the bearing 56 in a vertical direction, and the driven roller 50 is driven by the driving roller 48.

From the viewpoint of easily and efficiently slipping each single Japanese paper tape 18, one or more types of rollers selected from a group including the driving roller 48 and the driven roller 50 are preferably a roller having a roller surface subjected to a smoothing process for paper, that is, a roller subjected to a process of reducing friction with paper on a roller surface to make the paper slippery on the roller surface. From the similar viewpoint, for example, one or more types of rollers selected from a group including the driving roller 48 and the driven roller 50 are more preferably a roller subjected to satin finish processing. Alternatively, from the similar viewpoint, the driving roller 48 is preferably chrome-plated on the roller surface, and the driven roller 50 is preferably satin-finished on the roller surface. A weight of the driven roller 50 is to be a pressing force set to such a degree that the Japanese paper tape 18 is not broken even if the single Japanese paper tape 18 sandwiched (nipped) between the driving roller 48 and the driven roller 50 slips against rotation of the driving roller 48. The single Japanese paper tape 18 is slid with respect to the driving roller 48 in a state of being sandwiched between the driving roller 48 and the driven roller 50. Tension of the single Japanese paper tape 18 between the yarn path member 22 and the pair of slip rollers 24 in the distributor 21 is measured in advance. A driven roller 50 having a light weight is selected in a case where the tension is high, and conversely, a driven roller 50 having a heavy weight is selected when the tension is low. The U-shaped bearing 56 is used to enable appropriate replacement with the driven roller 50 having a different weight.

The driving roller 48 of each pair of slip rollers 24 illustrated in FIGS. 5A and 5B is rotated so as to feed the single Japanese paper tape 18 illustrated in FIGS. 5A and 5B at a surface speed of, as compared with a feeding speed Ext each single Japanese paper tape 18 included in the plurality of paper tapes 17 by the pair of feeding rollers 20 illustrated in FIGS. 1A and 1B, more than 1.000 times, preferably 1.005 times or more and 1.050 times or less, more preferably 1.005 times or more and 1.025 times or less, and even more preferably 1.010 times or more and 1.020 times or less. The numerical range of 1.005 times or more and 1.050 times or less mentioned here is not a theoretical numerical range, but is a numerical range in which the inventor of the present application has obtained preferable observation results described below by repeating experiments. As an observation result, when the surface speed of the driving roller 48 of each pair of slip rollers 24 illustrated in FIGS. 5A and 5B is increased as compared with the feeding speed of the feeding roller 20 illustrated in FIGS. 1A and 1*a* the driving roller 48 is always slipped with respect to each single Japanese papertape 18, and each single Japanese paper tape 18 on an upstream side (the pair of feeding rollers 20 side) with respect to the pair of slip rollers 24 is not loosened all the time. As an observation result, since the driving roller 48 always in a state of slipping with respect to each single Japanese paper tape 18, a rapid change in tension in a feeding direction has not been applied to each single Japanese paper tape 18, and each single Japanese paper tape 18 has not broken. In each single Japanese paper tape 18, it is considered that the tension fluctuates due to ballooning during false-twisting described later. However, since the fluctuation of the tension is absorbed by slipping between the driving roller 48 and the driven roller 50 provided in the pair of slip rollers 24, it is considered from the observation result that each single Japanese paper tape 18 will substantially no longer break. The pair of slip rollers 24 are arranged for each single Japanese paper tape 18. As illustrated in FIG. 6, the pair of slip rollers 24 are arranged so as to supply the single Japanese paper tape 18 for each single covering unit 26.

It is preferable that the driving roller 48 of the pair of slip rollers 24 is configured to be slipped almost constantly with respect to the single Japanese paper tape 18. This slip may be performed continuously or intermittently. That is, when a ratio between a surface speed of the driving roller 48 and a feeding speed of the feeding roller 20 is set to be equal to or less than breaking elongation of the Japanese paper tape 18, the single Japanese paper tape 18 is stretched on a surface of the driving roller 48, the driving roller 48 is rotated in a state of not slipping, and the single Japanese paper tape 18 is fed out. When excessive tension is applied to the single Japanese paper tape 18, a slip occurs between the single Japanese paper tape 18 and the surface of the driving roller 48. It is assumed that the slip is intermittently performed in this manner, but such a case is also included in the present invention.

[Support Roller]

As illustrated in FIGS. 1A and 1B, each single Japanese paper tape 18 is conveyed to the covering unit 26 after the Japanese paper sheet 12 is slit by the slitter 16 to form the plurality of Japanese paper tapes 17. Each single Japanese paper tape 18 is preferably supported appropriately by at least one support roller 57 from formation to conveyance to the covering unit 26, From the viewpoint of suppressing resistance applied to each single Japanese paper tape 18 to be small, it is preferable to suppress the number of pieces of the at least one support roller 57 to be small.

[Covering Machine]

For example, as illustrated in FIG. 6, the covering machine 25 is provided with a plurality of covering units such that the single covering unit 26 corresponds to each single Japanese paper tape 18 fed out from the pair of slip rollers 24. From the viewpoint of cost saving and space saving, it is preferable that arrangement of the plurality of covering units provided in the covering machine 25 is made such that, after half of the plurality of covering units are classified into a first unit group 59 and the remaining half are classified into a second unit group 60, the first unit group 59 and the second unit group 50 are arranged face to face or back to back along a feeding direction of each single Japanese paper tape 18 as illustrated in FIGS. 1A and 1B and 6. By arranging in this manner, all the driving rollers included in the plurality of pairs of slip rollers 24 corresponding to the respective covering units 26 included in the first unit group 59 are arranged in a row, and thus can be collectively driven by one driveshaft 52. Similarly, all the driving rollers included in the plurality of pairs of slip rollers 24 corresponding to the respective covering units 26 included in the second unit group 60 can be collectively driven by another driveshaft 52. If these two drive shafts are connected by a gear, a belt, a chain, or the like and driven by one driving device, cost saving can be achieved. Further, a traveling belt 65 (see FIGS. 7 and 8) to be described later, which is arranged corresponding to each single Japanese paper tape 18 fed out from each pair of slip rollers 24 and is for driving each covering unit 26, can also be configured by one piece, and further cost reduction can be achieved. Note that a direction changing jig 56 is preferably arranged such that the Japanese paper tape 18 distributed one by one by the plurality of holes 46 provided in the distributor 21 is guided to the pair of slip rollers 24 arranged corresponding to any covering unit 26. An example of the direction changing jig 58 is a snail wire.

As illustrated in FIG. 7, in each covering unit 26, a covering yarn (compound paper yarn) 80 is manufactured from the single paper tape 18, at least one core yarn (first yarn) 72, and at least one secondary yarn (second yarn) 70. The at least one core yarn (first yarn) 72 is at least one piece of yarn selected from a group including a first long fiber, a first spun yarn, and a compound yarn in which the first long fiber and the first spun yarn are combined. The at least one secondary yarn (second yarn) 70 is at least one piece of yarn selected from a group including a second long fiber, a second spun yarn, and a compound yarn in which the second long fiber and the second spun yarn are combined. The first long fiber is appropriately selected in accordance with a purpose of a final product in which the covering yarn (compound paper yarn) 80 is used, and examples thereof include a polyester filament yarn having a fineness of 20 denier (22.2 dtex) or more and 30 denier (33.3 dtex) or less. For the similar reason, the second long fiber is also appropriately selected in accordance with a purpose of a final product, and examples thereof include a polyester filament yarn having a fineness of 20 denier (22.2 dtex) or more and 30 denier (33.3 dtex) or less. A material of the first long fiber or a material of the second long fiber may be, for example, nylon, rayon, or the like. Examples of the first spun yarn or the second spun yarn include a yarn that is spun using natural fibers or synthetic fibers. Examples of the compound yarn include a twisted union yarn of a long fiber and a spun yarn, a yarn in which a spun yarn is wound around an outer periphery of a long fiber, and the like. From the viewpoint of a yarn with easy elongation and the viewpoint of easy manufacturing of the covering yarn (compound paper yarn) 80, the at least one core yarn (first yarn) 72 is preferably at least one first long fiber, and more preferably one first long fiber. From the similar viewpoint, the at least one secondary yarn (second yarn) 70 is preferably at least one second long fiber, and more preferably one second long fiber.

Each covering unit 26 includes the covering mechanism 82 having: a rotational tubular body 66 that is supported by a bearing 64 fixed to a frame 63 and rotated by bringing a part of an outer periphery into contact with the traveling belt 65; and a wound body 71 in which the at least one secondary yarn (second yarn) 70 is wound around a hollow bobbin 68 externally mounted on the rotational tubular body 66. The at least one secondary yarn 70 may be one piece or a plurality of pieces. The at least one secondary yarn 70 may be of the same type or different types in a case of including a plurality of pieces, and a plurality of secondary yarns of the same type or different types are preferably bound and wound around the hollow bobbin 68 in advance. The rotational tubular body 66 is rotatably erected in a perpendicular direction by the bearing 64. In an upper portion and a lower portion of the rotational tubular body 66, openings are individually provided. Each covering unit 26 includes the false-twisting mechanism 81 in which a linear member 67 having a U-shape, a V-shape, a line shape, or the like is attached so as to straddle a diameter direction of a tube of the rotational tubular body 66 in the opening provided in the lower portion of the rotational tubular body 66. A shape, an attachment structure, and the like of the linear member 67 are not limited. In general, false-twisting refers to a process of continuously carrying out a step of applying twists to (twisting) a yarn such as a long fiber or a spun yarn, and then releasing the twists of (untwisting) the yarn. In the rotational tubular body 66, the covering mechanism 82 and the false-twisting mechanism 81 have a substantially integrated structure. The traveling belt 65 is an endless belt that is caused to travel by a driving device (not illustrated), and is configured such that each rotational tubular body 66 is simultaneously rotatable in the plurality of covering units. Above each rotational tubular body 66, the pair of slip rollers 24 is arranged, and the single Japanese paper tape 18 is fed from the pair of slip rollers 24 into the tube of the rotational tubular body 66.

In the vicinity of the pair of slip rollers 24, a wound body 73 in which at least one core yarn (first yarn) 72 is wound around a roll is arranged. The core yarn 72 is fed through a tube 74 or the like arranged in the vicinity of an exit of the pair of slip rollers 24, and merged with the single Japanese paper tape 18 fed out from the pair of slip rollers 24 while being slipped, to be added to the Japanese paper tape 18. The at least one core yarn (first yarn) 72 may be one piece or a plurality of pieces, or may be one type or a plurality of types. The number of wound bodies and tubes corresponding to the number of core yarns 72 and the number of types thereof are arranged. When two or more types of core yarns are used, two or more types of core yarns may be bundled and wound around a roll in advance. For the reason described later, the Japanese paper tape 18 and the core yarn 72 that have merged are twisted together in a process of being fed downward from a merging position to temporarily form a twisted union yarn 78. A cross-sectional outer shape of the twisted union yarn 78 in a direction orthogonal to the longitudinal direction is substantially circular. Further, the secondary yarn 70 wound around the hollow bobbin 68 is unwound, and the secondary yarn 70 is wound around an outer periphery of the twisted union yarn 78. That is, an outer periphery of the twisted union yarn 78 is covered with the at least one secondary yarn 70. The twisted union yarn 78 covered with the at least one secondary yarn 70 travels and passes from an upper side to a lower side in the tube of the rotational tubular body 66, is engaged with the linear member 67 so as to be rotated once around the linear member 67 arranged at the lower portion of the rotational tubular body 66, and then is drawn out downward from the linear member 67. With such a configuration, due to the reason described later, the linear member 67 forms a fiber bundle in which the single Japanese paper tape 18 and the at least one core yarn 72 are false-twisted, and an outer periphery of the fiber bundle is covered with the secondary yarn 70. The twisted union yarn 78 covered with the secondary yarn 70 is engaged with the linear member 67, then untwisted while being drawn out downward from the linear member 67 by a delivery roller 77, and wound around a winder 76.

In such a configuration, since the Japanese paper tape 18 and the core yarn 72 are wound around the linear member 67, the Japanese paper tape 18 and the core yarn 72 are twisted while traveling in a section from the merging position of the Japanese paper tape 18 and the core yarn 72 to the linear member 67 to temporarily form the twisted union yarn 78. Therefore, the section from merging of the Japanese paper tape 18 and the at least one core yarn 72 to engaging with the linear member 67 functions as a twisting region 61. A section from engaging, with the linear member 67, of the twisted union yarn 78 temporarily formed while being covered with the at least one secondary yarn 70 in the twisting region 61 to reaching the delivery roller 77 while being drawn downward and untwisted functions as an untwisting region 62. Therefore, the linear member 67 functions as a false-twisting spindle part. The false-twisting spindle part in each covering unit 26 is not limited to the linear member 67, and may be replaced with, for example, a known false-twisting mechanism.

More specifically, the core yarn 72 is drawn out from the wound body 73 at a feeding speed of the delivery roller 77. Whereas, the single Japanese paper tape 18 is fed out from the pair of slip rollers 24 while being slipped, and is supplied to the twisting region 61 in a state of being overfed by the slip as compared with the core yarn (first yarn) 72. The single Japanese paper tape 18 is twisted with the core yarn 72 so as to be wound around the core yarn 72 in the twisting region 61, by a length supplied more in the overfed state as compared with a length of the core yarn 72 to temporarily form the twisted union yarn 78. If a supply amount of the Japanese paper tape is excessively smaller than a supply amount of the core yarn, a problem that the Japanese paper tape breaks by being pulled by the core yarn. From the viewpoint of solving this problem, it is preferable to adjust a feeding speed of the pair of feeding rollers 20 (see FIGS. 1A and 1B) and a feeding speed of the delivery roller 77, to adjust the feeding speed of the pair of feeding rollers 20 (the feeding speed of the Japanese paper tape 18) to 1.05 times or more and 1.35 times or less as compared with the feeding speed of the delivery roller 77 (the feeding speed of the core yarn 72). Since the driving roller 48 of the pair of slip rollers 24 is quickly rotated so as to be slipped with respect to the Japanese paper tape 18, the feeding speed (supply amount) of the Japanese paper tape 18 from the pair of slip rollers 24 is the same as the feeding speed (supply amount) of the pair of feeding rollers 20 (see FIGS. 1A and 1B).

The twisted union yarn 78 covered with the at least one secondary yarn 70 in the twisting region 61 illustrated in FIG. 7 is untwisted in the untwisting region 62, and wound around the winder 76 as the covering yarn (compound paper yarn) 80. The single Japanese paper tape 18 and the core yarn 72 are temporarily twisted in the twisting region 61 to form the twisted union yarn 78 and then untwisted in the untwisting region 62, that is, false-twisted. The false-twisted Japanese paper tape 18 is wrinkled without returning to an original flat shape even if the twist is released. As compared with the twisted union yarn 78 temporarily formed in the twisting region 61, the Japanese paper tape 18 and the core yarn 72 obtained by untwisting the twisted union yarn 78 in the untwisting region 62 are not sufficiently twisted, but both are covered with the secondary yarn 70. Therefore, a form of the covering yarn (compound paper yarn) 80 is held in which the cross-sectional outer shape in the direction orthogonal to the longitudinal direction is substantially circular.

The rotational tubular body 66 is rotated at a high speed by each covering unit 26, and the single Japanese paper tape 18 and the core yarn 72 that travel so as to pass through the tube of the rotational tubular body 66 from the upper side to the lower side are twisted via the linear member 67 rotating at a high speed together with the rotational tubular body 66, and are twisted together in the twisting region 61 to temporarily form the twisted union yarn 78. Similarly, twisting is applied via the linear member 67 rotating at a high speed, and the secondary yarn 70 is wound around an outer periphery of the twisted union yarn 78. The number of rotations of the rotational tubular body 66 is determined in consideration of a thickness and a travelling speed of the Japanese paper tape 18 and the core yarn 72 when covered with the secondary yarn 70, and a thickness of the secondary yarn 70. The number of rotations of the rotational tubular body 66 is preferably set such that an angle (spiral angle) between a longitudinal direction of the covering yarn (compound paper yarn) 80 and a direction along a spiral of the secondary yarn 70 is 20 degrees or more and 45 degrees or less. Depending on a purpose of the covering yarn (compound paper yarn) 80, the spiral angle may be set outside this range. In the tube of the rotational tubular body 66, the single Japanese paper tape 18, the core yarn 72, and the secondary yarn 70 are applied with a centrifugal force and swung in a drum shape (ballooning) to be twisted. It is considered that pulsation (fluctuation in tension) occurs in the feeding direction of the Japanese paper tape 18 when the planar Japanese paper tape 18 is twisted such that the cross-sectional outer shape becomes substantially circular. However, since there is room for the Japanese paper tape 18 to be swingable along the traveling direction by the pair of slip rollers 24, a slight impact due to pulsation is alleviated, the Japanese paper tape 18 is less likely to be pulled when the Japanese paper tape 18 is twisted with the core yarn 72, and breakage of the Japanese paper tape 18 can be avoided. Further, when the Japanese paper tape 18 is fed to the covering unit 26 by the pair of slip rollers 24, a speed difference is not generated even locally in the feeding direction of the Japanese paper tape 18. Therefore, the Japanese paper tape 18 and the core yarn 72 are likely to be equally false-twisted over the longitudinal direction.

In a case where a feeding speed of the Japanese paper tape 18 (a feeding speed of the feeding roller 20) is set to 1.05 times or more and 1.35 times or less as compared with a feeding speed of the core yarn 72 (a speed of the delivery roller 77), that is, in a case of supplying the Japanese paper tape 18 to the twisting region 61 while slipping such that a length of Japanese paper tape 18 is 1.05 times or more and 1.35 times or less as compared with a length of the core yarn 72, there is substantially no breakage of the Japanese paper tape 1 portion in a low elongation range even if being pulled, in the formed twisted union yarn 78 and covering yarn (compound paper yarn) 80. In this case, although the breaking elongation is small, the Japanese paper tape 18 portion in the twisted union yarn 78 and the covering yarn (compound paper yarn) 80 is extended with a margin by an amount (overfeed amount) extra wound around the core yarn 72 that is easy to stretch. Therefore, the twisted union yarn 78 or the covering yarn (compound paper yarn) 80 substantially does not break in the low elongation range. Further, in this case, sufficient elongation is secured in the covering yarn (compound paper yarn) 80 itself, and the breaking strength is increased. For this reason, the feeding speed of the Japanese paper tape 18 (the feeding speed of the feeding roller 20 (see FIGS. 1A and 1B) is preferably set to 1.05 times or more and 1.35 times or less as compared with the feeding speed of the core yarn 72 (the speed of the delivery roller 77), but is more preferably 1.10 times or more and 1.20 times or less, and even more preferably 1.15 times or more and 1.16 times or less. From the viewpoint of avoiding a situation in which the twisted Japanese paper tape 18 portion breaks when the covering yarn (compound paper yarn) 80 is pulled, it is more preferable that the Japanese paper tape 18 is overfed so as to have a length of 1.05 times or more as compared with the core yarn 72. Whereas, from the viewpoint of avoiding a situation in which the Japanese paper tape 18 portion protrudes from a surface of the covering yarn (compound paper yarn) 80, it is preferable that excessive overfeed is avoided so that the Japanese paper tape 18 has a length of 1.35 times or less the length as compared with the core yarn 72.

[Effects]

As described above, in the compound paper yarn manufacturing device 10 according to the embodiment of the present invention illustrated in FIGS. 1A and 1B, the Japanese paper sheet 12 fed out from the Japanese paper roll 14 is slit by the slitter 16, and a plurality of narrow Japanese paper tapes 17 are formed. Each Japanese paper tape 18 included in the plurality of Japanese paper tapes 17 is fed out by the pair of feeding rollers 20, and is distributed in any direction one by one by the distributor 21. As illustrated in FIG. 6, the distributed each single Japanese paper tape 18 is fed to the covering unit 26 while being slipped by the pair of slip rollers 24. As illustrated in FIG. 7, the covering yarn (compound paper yarn) 80 is manufactured by each covering unit 26. In this series of manufacturing steps, it is not necessary to substantially interpose a worker after the operation of the compound Japanese paper yarn manufacturing device 10 is started, so that laborsaving can be achieved as compared with the conventional art. Since the covering yarn (compound paper yarn) 80 is continuously manufactured in each step, there is no time loss, and the covering yarn (compound paper yarn) can be quickly manufactured. Therefore, the manufacturing cost of the compound paper yarn can be greatly reduced as compared with the conventional art, and a stable and inexpensive compound paper yarn can be provided.

Further, as illustrated in FIG. 7, by providing each pair of slip rollers 24, and increasing a rotational speed (surface speed) of the driving roller 48 more than 1.00 times as compared with a feeding speed of the feeding roller 20 (see FIGS. 1A and 1B), breakage of the Japanese paper tape 18 can be avoided when the Japanese paper tape 18 and the core yarn 72 are false-twisted. By setting a feeding speed of the Japanese paper tape 18 to 1.05 times or more and 1.35 times or less as compared with the feeding speed of the core yarn 72, there is substantially no breakage of only the Japanese paper tape 18 portion as long as a stretch rate of the covering yarn (compound paper yarn) 80 is 5% or less, even if the manufactured covering yarn (compound paper yarn) 80 is pulled at breaking elongation or more of the original material of the Japanese paper tape 18, and there is no breakage of only the Japanese paper tape 18 portion even when the stretch rate is more than 5% and 10% or less.

From the viewpoint of omitting complicated initial setting work, in a case where the Japanese paper sheet 12 of the Japanese paper roll 14 is completely fed out and is about to run out at the time of operating the compound paper yarn manufacturing device 10 illustrated in FIGS. 1A and 1B, it is preferable to temporarily stop the compound paper yarn manufacturing device 10 before the Japanese paper sheet 12 runs out and replace with a new Japanese paper roll 14. From the similar viewpoint, it is preferable that a front end portion of the Japanese paper sheet 12 drawn out from the new Japanese paper roll 14 and a rear end portion of the preceding Japanese paper sheet 12 are joined with an adhesive or the like, and the compound paper yarn manufacturing device 10 is restarted. A joined portion between the Japanese paper sheets 12 is preferably removed later.

An embodiment of the present invention has been described above on the basis of the compound paper yarn manufacturing device 10. The present invention is not limited to the form of the compound paper yarn manufacturing device 10, and for example, a part of the configuration in the compound paper yarn manufacturing device 10 may be changed or replaced as described below.

[Another Covering Machine]

Figure 8:
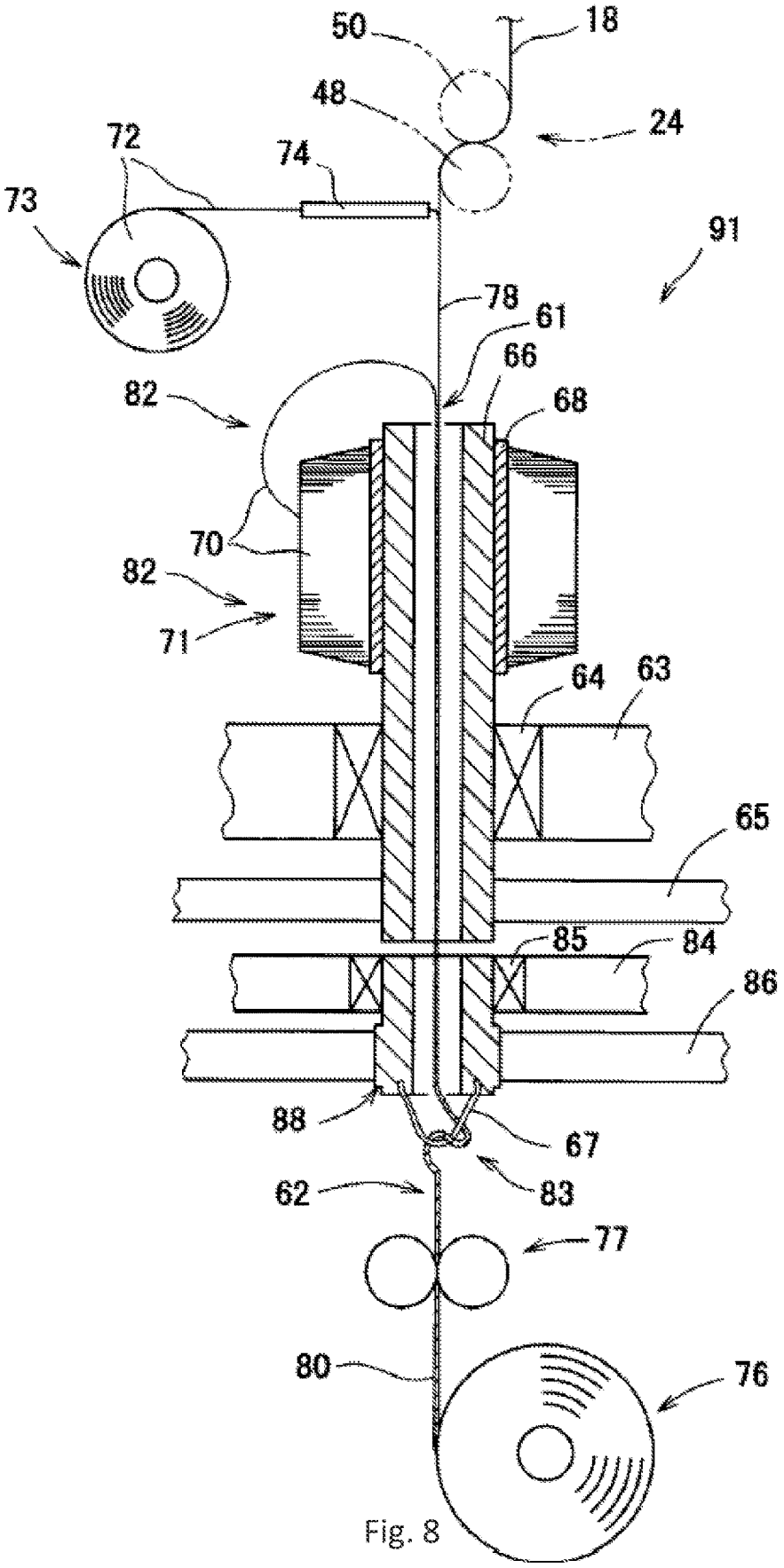
FIG. 8 is an explanatory view illustrating a schematic configuration of another example of each covering unit provided to a covering machine included in the compound paper yarn manufacturing device according to the embodiment of the present invention.

Each covering unit provided in the covering machine 25 illustrated in FIGS. 1A and 1B may be replaced with a covering unit 91 in a form described below with reference to FIG. 8, instead of the covering unit 26 in the form described with reference to FIG. 7. The covering unit 91 includes a false-twisting, mechanism 83 and a covering mechanism 82. The covering mechanism 82 of the covering unit 91 includes: a rotational tubular body 66 that is supported by a bearing 64 fixed to a frame 63 and rotated by bringing a part of an outer periphery into contact with a traveling belt 65; and a wound body 71 in which at least one secondary yarn (second yarn) 70 is wound around a hollow bobbin 68 externally mounted on the rotational tubular body 66. The rotational tubular body 66 is rotatably erected in a perpendicular direction by the bearing 64, The false-twisting mechanism 83 is provided below the rotational tubular body 66. The false-twisting mechanism 83 of the covering unit 91 is provided with a spindle 88 that is supported by a bearing 85 fixed to frame 84 and is rotated by bringing a part of an outer periphery into contact with a traveling belt 86. The spindle 88 has a tubular shape that is upright and has openings in an upper portion and a lower portion individually, and a linear member 67 having a U shape, a V shape, or the like is attached to the opening in the lower portion so as to straddle a diameter direction of the tube. The rotational tubular body 66 and the spindle 88 are provided coaxially. Each of the traveling belts (64 and 86) is an endless belt to be caused to travel by a driving device (not illustrated), and is caused to travel at any speed, and a rotational speed of the rotational tubular body 66 and a rotational speed of the spindle 88 can be appropriately set. Therefore, the number of windings of the secondary yarn (second yarn) 70 used for covering in a manufactured covering yarn (compound paper yarn) 80, and the number offal se twists of a paper tape 18 and a core yarn (first yarn) 72 in a twisting region 61 can be identical or different.

In the covering unit 91, a section from merging of the Japanese paper tape 18 with at least one core yarn (first yarn) 72 to engaging with the linear member 67 of the spindle 88 functions as the twisting region 61 in which the Japanese paper tape 18 and the core yarn 72 are twisted to temporarily form a twisted union yarn 78. The covering mechanism 82 is provided in the twisting region 61, and the twisted union yarn 78 is covered with the secondary yarn (second yarn) in the twisting region 61. A section in which the twisted union yarn 78 covered with the secondary yarn 70 is untwisted while being drawn out downward from the linear member 67 to reach a delivery roller 77 functions as an untwisting region 62. Other configurations and operations in the covering unit 91 are the same as the configurations and operations in the covering unit 26 described with reference to FIG. 7, and thus description thereof is omitted.

Each covering unit in the compound paper yarn manufacturing device according to the present invention may be replaced with a covering unit of a form in which a covering mechanism is arranged below a false-twisting mechanism, instead of the covering unit 26 illustrated in FIG. 7 or the covering unit 91 illustrated in FIG. 8. In each covering unit having such a form, after the Japanese paper tape 18 fed out from the pair of slip rollers 24 while being slipped passes from an upper side to a lower side through a twisting region for forming the twisted union yarn 78 by being twisted with the core yarn (first yarn) 70 by the false-twisting mechanism, outer peripheries of the Japanese paper tape 18 and the core yarn 70 are covered with the secondary yarn (second yarn) 70 in an untwisting region where the twisted union yarns 78 is untwisted. Even in the covering unit having such a form, similar operations and effects as those of the covering unit 26 described with reference to FIG. 7 can be sufficiently obtained.

Other Embodiments

The compound paper yarn manufacturing device 10 described with reference to FIGS. 1A and 1B is a form suitable for, for example, arranging the Japanese paper roll 14, the slitter 16, the pair of feeding rollers 20, and the like on a floor of the second floor of a building, and arranging the covering machine 25 and the like on a floor of the first floor. The compound paper yarn manufacturing device according to the present invention is not limited to the form in which the Japanese paper roll 14, the slitter 16, the pair of feeding rollers 20, the covering machine and the like are arranged over two floors in a building, and for example, may have a form in which they are arranged on one floor in a building. In another embodiment illustrated in FIG. 9, in order to enable a Japanese paper tape 18 to be supplied to each covering unit 26 from above, it is preferable to cause the Japanese paper tape 18 to travel in a state of being lifted above the covering unit 26, by providing at least one support column 94 and providing a direction changing jig 58 (for example, a snail wire) at a di gal end of the support column 94.

Figure 9:
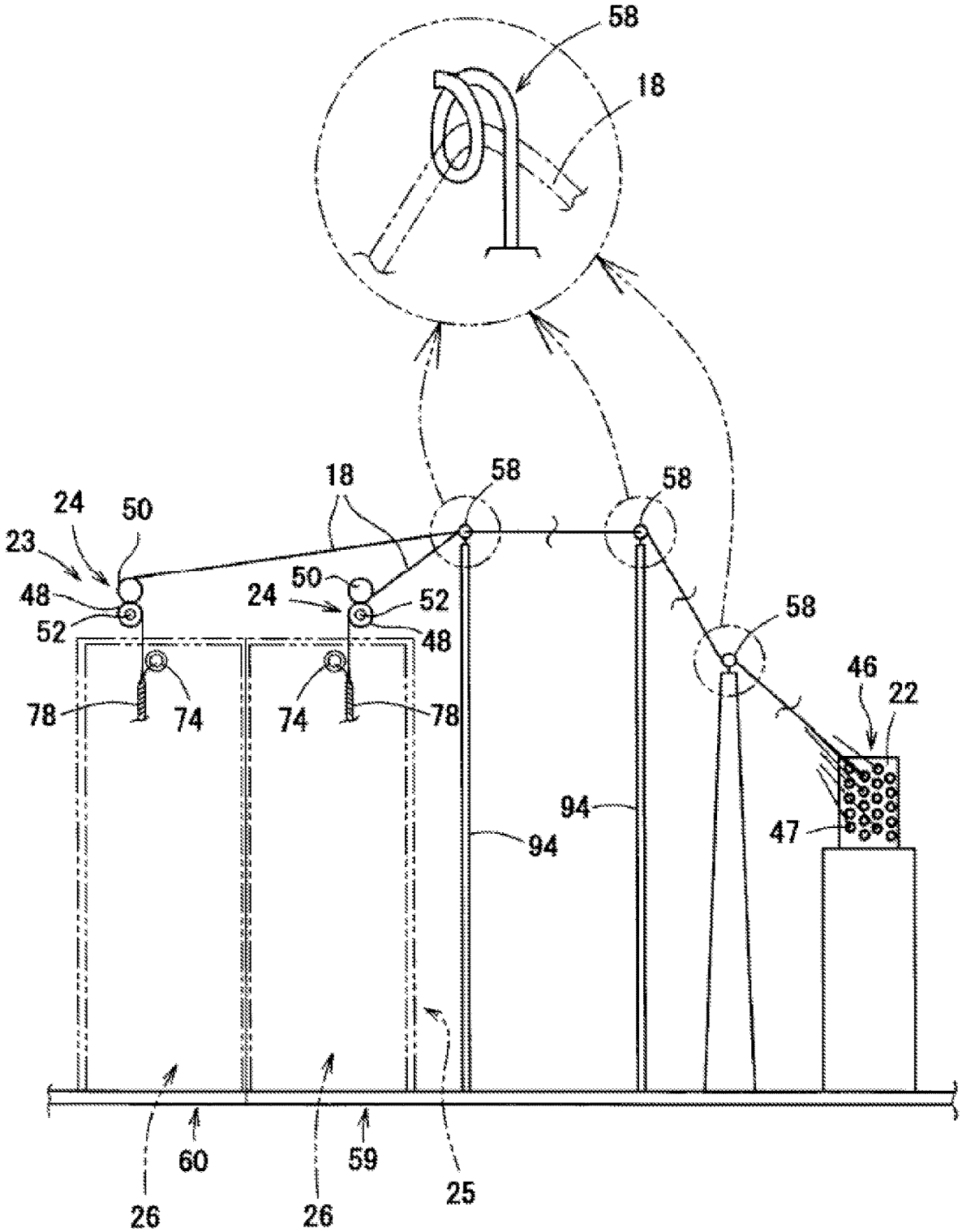
FIG. 9 is an enlarged explanatory view of a main part illustrating another example of arrangement of a yarn path member in a distributor included in a compound paper yarn manufacturing device according to another embodiment of the present invention and each covering unit provided to a covering machine.

In the another embodiment illustrated in FIG. 9, a configuration has been exemplified in which, assuming that about 120 pieces of Japanese paper tape are used as a plurality of Japanese paper tapes, a plurality of covering units are arranged side by side on the right side or the left side with respect to a feeding direction of the plurality of Japanese paper tapes. From the viewpoint of efficiently manufacturing more compound paper yarns, for example, it is preferable to be able to simultaneously manufacture 240 covering yarns (compound paper yarns) by arranging the plurality of covering units on each of the right side and the left side with respect to the feeding direction of the plurality of Japanese paper tapes. In the present invention, the number of Japanese paper tapes and the arrangement of the plurality of covering units described here are merely examples, and are not particularly limited.

[Arrangement of Covering Machine]

Figure 10:
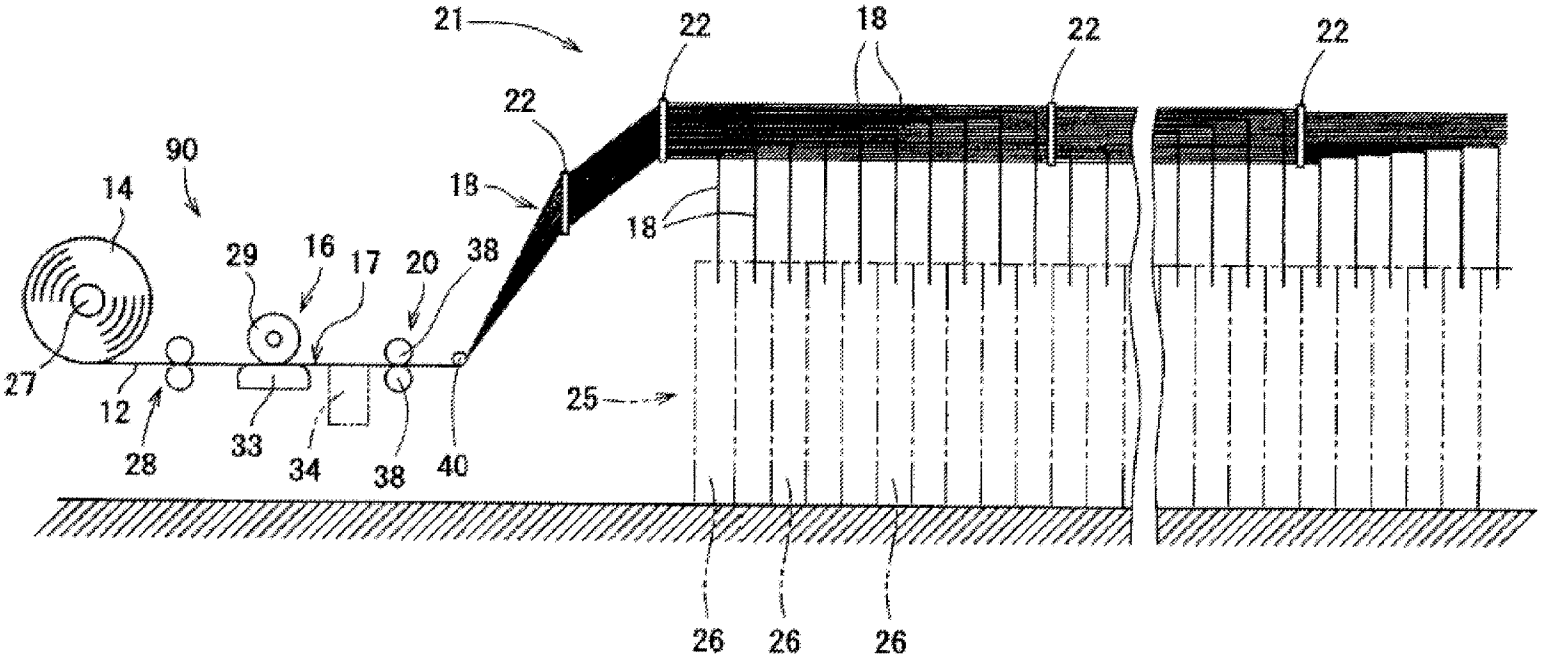
FIG. 10 is a front view illustrating a schematic configuration of another compound paper yarn manufacturing device according to another embodiment of the present invention.

As illustrated in FIG. 10, in the present invention, as another embodiment suitable for installing the Japanese paper roll 14, the slitter 16, the pair of feeding rollers 20, the covering machine 25, and the like on one floor in a building, for example, a compound paper yarn manufacturing device 90 illustrated in FIG. 10 is preferably mentioned. The compound paper yarn manufacturing device 90 includes: a Japanese paper roll 14 in which a long Japanese paper sheet 12 is wound in a roll shape; a slitter 16 configured to slit the Japanese paper sheet 12 fed out from the Japanese paper roll 14 to form a plurality of Japanese paper tapes 17 having a narrow width in a feeding direction of the Japanese paper sheet 12; a pair of feeding rollers 20 configured to sandwich (nip) and feed out each Japanese paper tape 18 included in the plurality of Japanese paper tapes 17 formed by the slitter 16, at a constant speed; a distributor 21 configured to distribute the plurality of paper tapes 17 conveyed by the pair of feeding rollers 20 into each single Japanese paper tape 18; a plurality of pairs of slip rollers (not illustrated); and a covering machine 25. The plurality of pairs of slip rollers are formed by providing a plurality of pieces of a pair of slip rollers such that the pair of slip rollers (not illustrated) correspond to the single paper tape 18 distributed from the plurality of paper tapes 17. Each pair of slip rollers sandwich (nip) and feed out the distributed the single paper tape 18 while slipping. The covering machine 25 is provided with a plurality of covering units such that a single covering unit 26 corresponds to each single paper tape 18 fed out from the pair of slip rollers. Each covering unit 26 winds at least one secondary yarn (second yarn) to perform covering processing in a yarn shape, while performing false-twisting on the single paper tape 18 fed out by the pair of slip rollers with at least one core yarn (first yarn) added.

In the compound paper yarn manufacturing device 90, the plurality of Japanese paper tapes 17 formed by slitting the Japanese paper sheet 12 by the slitter 16 are fed out by the pair of feeding rollers 20 and then pressed by a pressing roller 40 to have a feeding direction bent upward. Below the feeding direction that has been bent in the plurality of Japanese paper tapes 17, a plurality of covering units provided in the covering machine 25 are linearly arranged. In a case where the number of the plurality of Japanese paper tapes 17 is 120, 60 covering units are arranged in a row. In face to face or back to back with the 60 covering units, other 60 covering units are arranged in a row. Therefore, a total of 120 covering units are arranged in face to face or back to back by 60 pieces. Above these 120 covering units, a pair of slip rollers (not illustrated) are arranged for each single covering unit 26.

While the plurality of Japanese paper tapes 17 with the feeding direction bent upward by the pressing roller 40 passes above the plurality of covering units, only one Japanese paper tape 18 is passed through each one hole (one guide path) by a plurality of holes (plurality of guide paths, not illustrated) provided on each yarn path member 22 in the distributor 21. Therefore, each single paper tape 18 is distributed so as to travel while maintaining an interval at which the paper tapes 18 are separated one by one so as not to interfere with each other. Among the plurality of Japanese paper tapes 17, two each distributed by the yarn path member 22 have a feeding direction bent downward through a plurality of direction changing jigs (for example, a snail wire, not illustrated), and are fed to two covering units included in the plurality of covering units arranged in two rows through a pair of slip rollers (not illustrated) arranged below the bent portion. Each covering unit 26 is as already described with reference to FIG. 7.

In the compound paper yarn manufacturing device 90, the Japanese paper roll 14, the slitter 16, the pair of feeding rollers 20, the covering machine 25, and the like are arranged on one floor in a building, so that a work environment can be completed on one floor. Therefore, workability is improved in the compound paper yarn manufacturing device 90 as compared with the case of arranging on two floors.

[Breakage Detection Device]

From the viewpoint of avoiding waste of continuously operating the plurality of covering units and winding only the core yarn 72 and the secondary yarn 70 even if the Japanese paper tape 18 breaks, in the compound paper yarn manufacturing device (10, 90), each covering unit 26 is preferably provided with a breakage detection device (not illustrated) configured to detect breakage of the Japanese paper tape 18. The breakage detection device may be provided at any location, and may be provided at a plurality of locations without limiting to one location. It is also preferable from the viewpoint that the covering unit 26 corresponding to the Japanese paper tape 18 can be selectively set to be stoppable when breakage of the Japanese paper tape 18 is detected by the breakage detection device. The breakage detection device may be a known one, and is preferably a so-called non-contact type such as an optical type or a capacitance type.

Each covering unit 26 may be provided with a breakage detection device capable of detecting breakage of the secondary yarn 70 or the core yarn 72. When breakage of the Japanese paper tape, the secondary yarn, the core yarn, or the like is detected by the breakage detection device, it is preferable to stop the covering unit 26 corresponding to the Japanese paper tape or the like whose breakage has been detected. However, without limiting to this, it is also preferable to notify the worker by blinking an alarm lamp or the like.

[Broken Japanese Paper Tape Discharging Device]

As in the compound paper yarn manufacturing device 10 illustrated in FIGS. 1A and 1B, it is preferable to provide, at any position, a broken Japanese paper tape discharging device 115 to remove a broken Japanese paper tape when at least one of the plurality of Japanese paper tapes 17 breaks. In a case where the Japanese paper sheet 12 is made very thin, there may be an unexpected hole in the Japanese paper sheet 12. In this case, when the Japanese paper sheet 12 is slit by the slitter 16 to form a plurality of narrow Japanese paper tapes 17, at least one Japanese paper tape is likely to break at a location where the hole is loaned. Therefore, the broken Japanese paper tape is preferably suctioned and removed by, the paper dust suction device 34. If there is a portion having a thin paper thickness in apart of the Japanese paper sheet 12, the formed Japanese paper tape may break in die middle of conveyance. From the viewpoint of preventing that the broken Japanese paper tape is left and accumulated to cause other Japanese paper tapes to break, the broken Japanese paper tape is preferably removed immediately. The broken Japanese paper tape discharging device 116 is preferably a suction type in which a suction port is provided in the vicinity where the plurality of Japanese paper tapes 17 are fed out by the pair of feeding rollers 20.

In the compound paper yarn manufacturing device (10, 90) according to the present invention, even when some of the plurality of Japanese paper tapes 17 break after the start of manufacturing, the manufacturing of the compound paper yarn can be continued as it is. In this case, from the viewpoint of not hindering a series of steps until the compound paper yarn is manufactured from a Japanese paper tape that is not broken, the broken Japanese paper tape is preferably suctioned and removed by the broken Japanese paper tape discharging device 116 (see FIG. 1) such as a suction device.

[Compound Paper Yarn]

A compound paper yarn according to the present invention is a compound paper yarn formed by covering, with a secondary yarn (second yarn), a fiber bundle formed by performing false-twisting on a single paper tape and at least one core yarn (first yarn) added to the single paper tape. From the viewpoint of increasing breaking elongation of the compound paper yarn and increasing breaking strength of the compound paper yarn, when this compound paper yarn is cut at a predetermined length in its longitudinal direction, as compared with a length of the first yarn included in a formed section of the compound paper yarn, a length of the single paper tape included in the section of the compound paper yarn is, for example, 1.05 times or more and 1.35 times or less, preferably 1.10 times or more and 1.20 times or less, and more preferably 1.145 times or more and 1.165 or less. Magnification of the length mentioned here can be freely adjusted by changing a ratio between a feeding speed of the delivery roller 77 illustrated in FIG. 6 or 7 and a feeding speed of the pair of feeding rollers 20 illustrated in FIGS. 1A and 1B or 10, irrespective of characteristics such as torsional characteristics of the core yarn (first yarn). That is, if the feeding speed of the pair of feeding rollers 20 is made faster than the feeding speed of the delivery roller 77, the magnification of the length described here can be increased.

As described above, in the compound paper yarn according to the present invention, a single Japanese paper tape having small breaking elongation is longer than the first yarn having large breaking elongation (a single paper tape is overfed than the first yarn). Therefore, the compound paper yarn according to the present invention is configured to be able to avoid a situation in which only the paper tape portion breaks when strongly pulled. When various types of garments and the like are manufactured using the compound paper yarn according to the present invention, it is possible to avoid a situation in which only the paper tape portion of the compound paper yarn breaks and the broken paper tape portion appears on a surface of clothing or the like. Therefore the possibility of manufacturing a defective product can be reduced as compared with a case of manufacturing clothing or the like using the conventional compound paper yarn. The compound paper yarn according to the present invention can be easily manufactured by using, for example, the compound paper yarn manufacturing device 10 illustrated in FIGS. 1A and 1B or the compound paper yarn manufacturing device 90 illustrated in FIG. 10. Therefore, the compound paper yarn according to the present invention is not limited to what type of device is used to manufacture the compound paper yarn, but is preferably manufactured using the compound paper yarn manufacturing device according to the present invention.

A first long fiber in the compound paper yarn according to the present invention is appropriately selected according to a purpose of a final product in which the compound paper yarn is used, and examples thereof include a polyester filament yarn having a fineness of 20 denier (22.2 dtex) or more and 30 denier (33.3 dtex) or less. A second long fiber in the compound paper yarn according to the present invention is similarly appropriately selected according to a purpose of a final product, and examples thereof include a polyester filament yarn having a fineness of 20 denier (22.2 dtex) or more and 30 denier (33.3 dtex) or less. A material of the first long fiber or a material of the second long fiber may be, for example, nylon, rayon, or the like. A first spun yarn may be used instead of the first long fiber. A second spun yarn may be used instead of the second long fiber.

Various woven fabrics or knitted fabrics (circular knitting, weft knitting, or warp knitting) can be manufactured using the compound paper yarn according to the present invention. These woven fabrics or knitted fabrics can be widely used for clothing (garments, inner wear, lining, or the like), shoes, socks, sheets, curtains, towels, a mask or gauze used for medical care or the like, a handkerchief, or the like, interior items such as chair upholstery and wall paper, industrial materials, or the like.

In addition, the present invention can be implemented in a mode to which various improvements, modifications, or variations are added on the basis of knowledge of those skilled in the art without departing from the gist of the present invention. Further, the present invention may be implemented in a form in which any of the matters used to specify the invention is replaced with another technology within a range in which the same action or effect is produced.

REFERENCE SIGNS LIST

10, 90: compound paper yarn manufacturing device
12: Japanese paper sheet (paper sheet)
14: Japanese paper roll (paper roll)
16: slitter
17: plurality of Japanese paper tapes (plurality of paper tapes)
18: Japanese paper tape (paper tape)
20: pair of feeding rollers
21: distributor
22: yarn path member
23: plurality of pairs of slip rollers
24: pair of slip rollers
25: covering machine
26, 91: covering unit
46: plurality of holes (plurality of guide paths)
47: hole (guide path)
48: driving roller
50: driven roller
52: drive shaft
61: twisting region
62: untwisting region
70: secondary yarn (second yarn)
72: core yarn (first yarn)
80: covering yarn (compound paper yarn)
81, 83: false-twisting mechanism
82: covering mechanism

The invention claimed is:

1. A compound paper yarn manufacturing device comprising:

a slitter configured to slit a paper sheet to form a plurality of paper tapes;

a pair of feeding rollers configured to sandwich and feed out a single paper tape, which is one of the plurality of paper tapes, at a constant speed;

a pair of slip rollers including a driving roller that is rotated at a surface speed of more than 1.000 times as compared with the constant speed of the pair of feeding rollers, the pair of slip rollers being configured to sandwich the single paper tape and feed out the single paper tape; and a covering machine provided with a single covering unit having a false-twisting mechanism configured to perform, with a first yarn added, false-twisting on the single paper tape fed out by the pair of slip rollers, the single covering unit having a covering mechanism configured to cover, with a second yarn, the single paper tape and the first yarn added to the single paper tape in a region of the false-twisting mechanism, wherein the pair of slip rollers include the driving roller and a driven roller, the driving roller is driven by a driving device and the driven roller is driven by the driving roller, the driving roller and the driven roller are arranged in a vertical direction in the pair of slip rollers, the driving roller is arranged below the driven roller, and the driven roller is arranged above, and configured to be vertically movable relative to, the driving roller such that the driving roller is configured to slip relative to the single paper tape, the first yarn is at least one piece of yarn selected from a group including a first fiber, a first spun yarn, and a compound yarn in which the first fiber and the first spun yarn are combined, and the second yarn is at least one piece of yarn selected from a group including a second fiber, a second spun yarn, and a compound yarn in which the second fiber and the second spun yarn are combined.

2. The compound paper yarn manufacturing device according to claim 1, wherein the surface speed of the driving roller in the pair of slip rollers is between 1.005 times and 1.050 times, inclusive, a feeding speed of the pair of feeding rollers.

3. The compound paper yarn manufacturing device according to claim 1, wherein a feeding speed of the single paper tape to be false-twisted with the at least one piece of the first yarn added is between 1.05 times and 1.35 times, inclusive, a feeding speed of the at least one piece of the first yarn.

4. The compound paper yarn manufacturing device according to claim 1, wherein at least one roller selected from a group including the driving roller and the driven roller has a roller surface subjected to a smoothing process for paper.

5. The compound paper yarn manufacturing device according to claim 4, wherein, in the pair of slip rollers, the driven roller is arranged to be changeable to a roller having any different weight.

6. A compound paper yarn manufactured by the compound paper yarn manufacturing device according to claim 1.

7. A compound paper yarn manufactured by the compound paper yarn manufacturing device according to claim 1, wherein, when the compound paper yarn is cut to a predetermined length, a length of the single paper tape included in a section of the compound paper yarn is between 1.05 times and 1.35 times, inclusive, a length of the first yarn included in a formed section of the compound paper yarn.

8. The compound paper yarn manufacturing device according to claim 1, wherein the driven roller is configured to be vertically movable relative to the driving roller responsive to a change in tension of the single paper tape.

9. The compound paper yarn manufacturing device according to claim 1, wherein the driven roller is configured to be vertically movable relative to the driving roller while the pair of slip rollers are rotating to feed out the single paper tape.

10. A compound paper yarn manufacturing device comprising:

a paper roll on which a paper sheet having a length is wound in a roll shape;

a slitter configured to slit the paper sheet fed out from the paper roll to form a plurality of paper tapes having a width, in a feeding direction of the paper sheet;

a pair of feeding rollers configured to sandwich and feed out the plurality of paper tapes formed by the slitter, at a constant speed;

a distributor having a plurality of guide paths each provided to allow a single paper tape alone to pass from the plurality of paper tapes conveyed by the pair of feeding rollers, the distributor being configured to separated the plurality of paper tapes into each of the single paper tapes;

a plurality of pairs of slip rollers obtained by providing a plurality of pieces of a pair of slip rollers such that the pair of slip rollers correspond to each of the single paper tapes distributed from the plurality of paper tapes, the pair of slip rollers including a driving roller that is rotated at a surface speed of more than 1.000 times as compared with the constant speed of the pair of feeding rollers and being configured to sandwich the single paper tape distributed by the distributor and feed out the single paper tape; and a covering machine provided with a plurality of single covering units such that each of the single covering units corresponds to each of the single paper tapes fed out by the pair of slip rollers, each of the single covering units having a false-twisting mechanism configured to perform, with a first yarn added, false-twisting on the single paper tape fed out by the pair of slip rollers, each of the single covering units having a covering mechanism configured to cover, with a second yarn, the single paper tape and the first yarn added to the single paper tape in a region of the false-twisting mechanism, wherein the pair of slip rollers include the driving roller and a driven roller, the driving roller is driven by a driving device and the driven roller is driven by the driving roller, the driving roller and the driven roller are arranged in a vertical direction in the pair of slip rollers, the driving roller is arranged below the driven roller, and the driven roller is arranged above, and configured to be vertically movable relative to, the driving roller such that the driving roller is configured to slip relative to the single paper tape, the first yarn is at least one piece of yarn selected from a group including a first fiber, a first spun yarn, and a compound yarn in which the first fiber and the first spun yarn are combined, and the second yarn is at least one piece of yarn selected from a group including a second fiber, a second spun yarn, and a compound yarn in which the second fiber and the second spun yarn are combined.

11. A compound paper yarn manufacturing method comprising:

slitting a paper sheet into a plurality of paper tapes;

feeding out a single paper tape which is one of the plurality of paper tapes;

feeding out the fed single paper tape via a pair of slip rollers including a driving roller that is driven by a driving device and a driven roller that is driven by the driving roller;

performing false-twisting, with a first yarn added, on the single paper tape fed out; and covering, with a second yarn, the single paper tape and the first yarn in a twisting region or an untwisting region in the step of performing false-twisting, wherein the first yarn is at least one piece of yarn selected from a group including a first fiber, a first spun yarn, and a compound yarn in which the first fiber and the first spun yarn are combined, and the second yarn is at least one piece of yarn selected from a group including a second fiber, a second spun yarn, and a compound yarn in which the second fiber and the second spun yarn are combined, wherein during the feeding, the driving roller and the driven roller are arranged in a vertical direction in the pair of slip rollers, the driving roller is arranged below the driven roller, and the driven roller is arranged above, and configured to be vertically movable relative to, the driving roller such that the driving roller is configured to slip relative to the single paper tape.

12. A compound paper yarn manufacturing method comprising:

preparing a paper sheet wound in a roll shape;

slitting the paper sheet to form a plurality of paper tapes having a width in a feeding direction of the fed paper sheet;

feeding out the plurality of paper tapes in a longitudinal direction;

separating the plurality of paper tapes into single paper tapes by a distributor;

feeding out each of the single paper tapes via a pair of slip rollers including a driving roller that is driven by a driving device and a driven roller that is driven by the driving roller;

performing false-twisting, with a first yarn added, on each of the single paper tapes fed out; and covering, with a second yarn, for each combination of the single paper tape and the first yarn in a twisting region or an untwisting region in the performing false-twisting, wherein the first yarn is at least one piece of yarn selected from a group including a first fiber, a first spun yarn, and a compound yarn in which the first fiber and the first spun yarn are combined, the second yarn is at least one piece of yarn selected from a group including a second fiber, a second spun yarn, and a compound yarn in which the second fiber and the second spun yarn are combined, and during the feeding, the driving roller and the driven roller are arranged in a vertical direction in the pair of slip rollers, the driving roller is arranged below the driven roller, and the driven roller is arranged above, and configured to be vertically movable relative to, the driving roller such that the driving roller is configured to slip relative to the single paper tape.

* * * * *